US010569792B2

(12) United States Patent
Fahmy et al.

(10) Patent No.: US 10,569,792 B2
(45) Date of Patent: Feb. 25, 2020

(54) VEHICLE CONTROL SYSTEM AND METHOD

(71) Applicant: General Electric Company, Schenectady, NY (US)

(72) Inventors: Sameh Fahmy, Montreal (CA); Jared Klineman Cooper, Melbourne, FL (US); Ajith Kuttannair Kumar, Erie, PA (US); Joseph Forrest Noffsinger, Lee's Summit, MO (US); Wolfgang Daum, Sussex, WI (US); Glenn Robert Shaffer, Erie, PA (US); Paul Kenneth Houpt, Schenectady, NY (US); David Lowell McKay, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 37 days.

(21) Appl. No.: 14/922,787

(22) Filed: Oct. 26, 2015

(65) Prior Publication Data

US 2016/0039439 A1 Feb. 11, 2016
US 2019/0002002 A9 Jan. 3, 2019

Related U.S. Application Data

(63) Continuation-in-part of application No. 14/155,454, filed on Jan. 15, 2014, now Pat. No. 9,671,358, and a
(Continued)

(51) Int. Cl.
*B61L 23/04* (2006.01)
*B61L 25/02* (2006.01)
(Continued)

(52) U.S. Cl.
CPC ..... *B61L 27/0088* (2013.01); *B61K 9/10* (2013.01); *B61L 15/0081* (2013.01);
(Continued)

(58) Field of Classification Search
CPC ..... B61K 9/10; B61L 23/044; B61L 27/0094; B61L 23/041; B61L 27/0088;
(Continued)

(56) References Cited

U.S. PATENT DOCUMENTS 2,104,601 A 1/1938 Young
2,104,652 A 1/1938 Inman
(Continued)

FOREIGN PATENT DOCUMENTS

AU 4074395 A 7/1996
AU 2007202928 A1 10/2007
(Continued)

OTHER PUBLICATIONS

Sperry, Sperry B-Scan Single Rail Walking Sticks, Informational pamphlet (4 pgs.).
(Continued)

*Primary Examiner* — Alesa Allgood
(74) *Attorney, Agent, or Firm* — Buckley, Maschoff & Talwalkar LLC

(57) ABSTRACT

A system and method for examining a route and/or vehicle system obtain a route parameter and/or a vehicle parameter from discrete examinations of the route and/or the vehicle system. The route parameter is indicative of a health of the route over which the vehicle system travels. The vehicle parameter is indicative of a health of the vehicle system. The discrete examinations of the route and/or the vehicle system are separated from each other by location and/or time. The route parameter and/or the vehicle parameter are examined to determine whether the route and/or the vehicle system is damaged and, responsive to determining that the route and/or the vehicle is damaged, the route and/or the vehicle system are continually monitored, such as by examination equipment onboard the vehicle system.

24 Claims, 4 Drawing Sheets

Related U.S. Application Data continuation-in-part of application No. 14/152,159, filed on Jan. 10, 2014, now Pat. No. 9,205,849, which is a continuation-in-part of application No. 13/478,388, filed on May 23, 2012, now abandoned, which is a continuation-in-part of application No. 12/573,141, filed on Oct. 4, 2009, now Pat. No. 9,233,696, and a continuation of application No. PCT/US2013/054284, filed on Aug. 9, 2013, and a continuation-in-part of application No. 11/385,354, filed on Mar. 20, 2006, now Pat. No. 9,733,625.

(60) Provisional application No. 62/134,518, filed on Mar. 17, 2015, provisional application No. 61/681,843, filed on Aug. 10, 2012, provisional application No. 61/729,188, filed on Nov. 21, 2012, provisional application No. 61/860,469, filed on Jul. 31, 2013, provisional application No. 61/860,496, filed on Jul. 31, 2013.

(51) Int. Cl.

| | |
|---|---|
| ***B61L 3/00*** | (2006.01) |
| ***B61L 27/00*** | (2006.01) |
| ***B61L 15/00*** | (2006.01) |
| ***B61K 9/10*** | (2006.01) |

(52) U.S. Cl.
CPC ..... *B61L 23/044* (2013.01); *B61L 27/0038* (2013.01); *B61L 27/0094* (2013.01)

(58) Field of Classification Search
CPC .. B61L 29/30; B61L 15/0036; B61L 15/0054; B61L 23/042; B61L 23/047; B61L 27/0077
See application file for complete search history.

(56) References Cited

U.S. PATENT DOCUMENTS 2,111,513 A 3/1938 Phinney
2,148,005 A 2/1939 Allen et al.
2,233,932 A 3/1941 Allen
2,289,857 A 7/1942 Allen
2,293,926 A 8/1942 Wallace
2,366,802 A 1/1945 Pflasterer
2,601,634 A 6/1952 Rivette
2,783,369 A 2/1957 Weber
2,925,552 A 2/1960 Cowan et al.
2,927,711 A 3/1960 Naggiar
3,246,141 A 4/1966 Ehrlich
3,508,496 A 4/1970 Larso
3,519,805 A 7/1970 Thorne-Booth
3,537,401 A 11/1970 Metzner
3,575,596 A 4/1971 Schatzel
3,650,216 A 3/1972 Harwick et al.
3,652,937 A * 3/1972 Garrott ..... G01P 3/52 104/300
3,655,962 A 4/1972 Koch
3,718,040 A 2/1973 Freeman et al.
3,781,139 A 12/1973 Lohse
3,791,473 A 2/1974 Rosen
3,794,833 A 2/1974 Blazek et al.
3,805,056 A 4/1974 Birkin
3,813,885 A 6/1974 Tabor
3,865,042 A 2/1975 Depaola et al.
3,886,870 A 6/1975 Pelabon
3,937,432 A 2/1976 Birkin
3,948,314 A 4/1976 Creswick et al.
4,003,019 A 1/1977 Tronel
4,005,838 A 2/1977 Grundy
4,041,283 A 8/1977 Mosier
4,042,810 A 8/1977 Mosher
4,062,419 A 12/1977 Kadota
4,075,632 A 2/1978 Baldwin et al.
4,100,795 A 7/1978 Panetti
4,117,463 A 9/1978 Norton
4,136,432 A 1/1979 Melley, Jr.
4,159,088 A 6/1979 Cosley
4,181,278 A 1/1980 Pascoe
4,181,943 A 1/1980 Mercer, Sr. et al.
4,214,647 A 7/1980 Lutts
4,241,403 A 12/1980 Schultz
4,253,399 A 3/1981 Spigarelli
4,262,209 A 4/1981 Berner
4,279,395 A 7/1981 Boggio et al.
4,324,376 A 4/1982 Kuhn
4,344,364 A 8/1982 Nickles et al.
4,355,582 A 10/1982 Germer
4,360,873 A 11/1982 Wilde et al.
4,361,202 A 11/1982 Minovitch
4,401,035 A 8/1983 Spigarelli et al.
4,425,097 A 1/1984 Owens
4,524,745 A 6/1985 Tominari et al.
4,548,164 A 10/1985 Yloenen et al.
4,561,057 A 12/1985 Haley, Jr. et al.
4,565,548 A 1/1986 Davis et al.
4,582,280 A 4/1986 Nichols et al.
4,582,580 A 4/1986 Goudal et al.
4,602,335 A 7/1986 Perlmutter
4,644,705 A 2/1987 Saccomani et al.
4,663,713 A 5/1987 Cornell et al.
4,711,418 A 12/1987 Auer, Jr. et al.
4,718,351 A 1/1988 Engle
4,735,385 A 4/1988 Nickles et al.
4,773,590 A 9/1988 Dash et al.
4,794,548 A 12/1988 Lynch et al.
4,827,438 A 5/1989 Nickles et al.
4,843,575 A 6/1989 Crane
4,853,883 A 8/1989 Nickles et al.
4,932,614 A 6/1990 Birkin
4,944,474 A 7/1990 Jones
5,055,835 A 10/1991 Sutton
5,109,343 A 4/1992 Budway
5,129,605 A 7/1992 Burns et al.
5,133,645 A 7/1992 Crowley et al.
5,177,684 A 1/1993 Harker et al.
5,181,541 A 1/1993 Bodenheimer
5,187,945 A 2/1993 Dixon
5,197,438 A 3/1993 Yamamoto
5,197,627 A 3/1993 Disabato et al.
5,201,294 A 4/1993 Osuka
5,230,613 A 7/1993 Hilsbos et al.
5,240,416 A 8/1993 Bennington
5,253,153 A 10/1993 Mathews et al.
5,261,366 A 11/1993 Regueiro
5,277,156 A 1/1994 Osuka et al.
5,313,924 A 5/1994 Regueiro
5,316,174 A 5/1994 Schutz
5,357,912 A 10/1994 Barnes et al.
5,363,787 A 11/1994 Konopasek et al.
5,365,902 A 11/1994 Hsu
5,388,034 A 2/1995 Allen et al.
5,394,851 A 3/1995 Cryer et al.
5,398,186 A 3/1995 Nakhla
5,398,894 A 3/1995 Pascoe
5,420,883 A 5/1995 Swensen et al.
5,433,182 A 7/1995 Augustin et al.
5,437,422 A 8/1995 Newman
5,441,027 A 8/1995 Buchanon et al.
5,459,666 A 10/1995 Casper et al.
5,460,013 A 10/1995 Thomsen
5,462,244 A 10/1995 Van Der Hoek et al.
5,487,002 A 1/1996 Diller et al.
5,487,516 A 1/1996 Murata et al.
5,492,099 A 2/1996 Maddock
5,533,695 A 7/1996 Heggestad et al.
5,565,874 A 10/1996 Rode
5,570,284 A 10/1996 Roselli et al.
5,574,649 A 11/1996 Levy
5,574,659 A 11/1996 Delvers et al.
5,583,769 A 12/1996 Saitoh
5,588,716 A 12/1996 Stumpe

(56) References Cited

U.S. PATENT DOCUMENTS 5,600,558 A 2/1997 Mearek et al.
5,605,134 A 2/1997 Martin
5,618,179 A 4/1997 Copperman et al.
5,642,827 A 7/1997 Madsen
5,651,330 A 7/1997 Jewett
RE35,590 E 8/1997 Bezos et al.
5,676,059 A 10/1997 Alt
5,680,120 A 10/1997 Tilleman
5,681,015 A 10/1997 Kull
5,699,986 A 12/1997 Welk
5,713,540 A 2/1998 Gerszberg et al.
5,720,455 A 2/1998 Kull et al.
5,735,492 A 4/1998 Pace
5,738,311 A 4/1998 Fernandez
5,740,547 A 4/1998 Kull et al.
5,755,349 A 5/1998 Brundle
5,758,299 A 5/1998 Sandborg et al.
5,775,228 A 7/1998 Lamba et al.
5,785,392 A 7/1998 Hart
5,803,411 A 9/1998 Ackerman et al.
5,813,635 A 9/1998 Fernandez
5,817,934 A 10/1998 Skantar
5,820,226 A 10/1998 Hart
5,828,979 A 10/1998 Polivka et al.
5,832,895 A 11/1998 Takahashi et al.
5,833,325 A 11/1998 Hart
5,836,529 A 11/1998 Gibbs
5,856,802 A 1/1999 Ura et al.
5,913,170 A 6/1999 Wortham
5,928,294 A 7/1999 Zelinkovsky
5,934,764 A 8/1999 Dimsa et al.
5,936,517 A 8/1999 Yeh
5,944,392 A 8/1999 Tachihata et al.
5,950,966 A 9/1999 Hungate et al.
5,950,967 A 9/1999 Montgomery
5,957,571 A 9/1999 Koster et al.
5,969,643 A 10/1999 Curtis
5,978,718 A 11/1999 Kull
5,983,144 A 11/1999 Bonissone et al.
5,986,577 A 11/1999 Bezos
5,986,579 A 11/1999 Halvorson
5,995,737 A 11/1999 Bonissone et al.
5,995,881 A 11/1999 Kull
5,998,915 A 12/1999 Scholz et al.
6,005,494 A 12/1999 Schramm
6,016,791 A 1/2000 Thomas et al.
6,067,496 A 5/2000 Benoliel et al.
6,067,964 A 5/2000 Ruoff et al.
6,081,769 A 6/2000 Curtis
6,088,635 A 7/2000 Cox et al.
6,092,021 A 7/2000 Ehlbeck et al.
6,102,009 A 8/2000 Nishiyama
6,112,142 A 8/2000 Shockley et al.
6,114,901 A 9/2000 Singh et al.
6,121,924 A 9/2000 Meek et al.
6,123,111 A 9/2000 Nathan et al.
6,125,311 A 9/2000 Lo
6,128,558 A 10/2000 Kernwein
6,129,025 A 10/2000 Minakami et al.
6,135,396 A 10/2000 Whitfield et al.
6,158,416 A 12/2000 Chen et al.
6,158,822 A 12/2000 Shirai et al.
6,163,089 A 12/2000 Kull
6,163,755 A 12/2000 Peer et al.
6,179,252 B1 1/2001 Roop et al.
6,192,863 B1 2/2001 Takase
6,195,020 B1 2/2001 Brodeur, Sr. et al.
6,198,993 B1 3/2001 Higashi et al.
6,216,095 B1 4/2001 Glista
6,216,957 B1 4/2001 Turunen, Jr.
6,219,595 B1 4/2001 Nickles et al.
6,225,919 B1 5/2001 Lumbis et al.
6,230,668 B1 5/2001 Marsh et al.
6,243,694 B1 6/2001 Bonissone et al.
6,263,265 B1 7/2001 Fera
6,263,266 B1 7/2001 Hawthorne
6,269,034 B1 7/2001 Shibuya
6,270,040 B1 8/2001 Katzer
6,275,165 B1 8/2001 Bezos
6,286,480 B1 9/2001 Chen et al.
6,295,816 B1 10/2001 Gallagher et al.
6,304,801 B1 10/2001 Doner
6,308,117 B1 10/2001 Ryland et al.
6,317,686 B1 11/2001 Ran
6,322,025 B1 11/2001 Colbert et al.
6,325,050 B1 12/2001 Gallagher et al.
6,332,106 B1 12/2001 Hawthorne et al.
6,349,702 B1 2/2002 Nishiyama
6,349,706 B1 2/2002 Hsu et al.
6,357,421 B1 3/2002 Pritchard
6,360,998 B1 3/2002 Halvorson et al.
6,363,331 B1 3/2002 Kyrtsos
6,377,215 B1 4/2002 Halvorson et al.
6,380,639 B1 4/2002 Soucy
6,404,129 B1 6/2002 Hendricx et al.
6,421,606 B1 7/2002 Asai et al.
6,427,114 B1 7/2002 Olsson
6,441,570 B1 8/2002 Grubba et al.
6,443,123 B1 9/2002 Aoki et al.
6,459,964 B1 10/2002 Vu et al.
6,459,965 B1 10/2002 Polivka et al.
6,484,074 B1 11/2002 Hazard et al.
6,487,478 B1 11/2002 Azzaro et al.
6,487,488 B1 11/2002 Peterson, Jr. et al.
6,490,523 B2 12/2002 Doner
6,493,627 B1 12/2002 Gallagher et al.
6,499,815 B1 12/2002 Daigle
6,501,393 B1 12/2002 Richards et al.
6,505,103 B1 1/2003 Howell et al.
6,520,124 B2 2/2003 Bohm, II
6,522,958 B1 2/2003 Dwyer et al.
6,523,787 B2 2/2003 Braband
6,533,223 B1 3/2003 Ireland
6,549,803 B1 4/2003 Raghavan et al.
6,557,526 B1 5/2003 Hoshino
6,564,172 B1 5/2003 Till et al.
6,584,953 B2 7/2003 Yomogida
6,585,085 B1 7/2003 Kumar
6,591,263 B1 7/2003 Becker et al.
6,591,758 B2 7/2003 Kumar
6,609,049 B1 8/2003 Kane et al.
6,612,245 B2 9/2003 Kumar et al.
6,612,246 B2 9/2003 Kumar
6,615,118 B2 9/2003 Kumar
6,615,188 B1 9/2003 Breen et al.
6,631,322 B1 10/2003 Arthur et al.
6,647,328 B2 11/2003 Walker
6,665,609 B1 12/2003 Franke et al.
6,668,217 B1 12/2003 Franke et al.
6,676,089 B1 1/2004 Katzer
6,691,022 B2 2/2004 Takemura et al.
6,694,231 B1 2/2004 Rezk
6,698,913 B2 3/2004 Yamamoto
6,701,064 B1 3/2004 De Haan et al.
6,712,045 B1 3/2004 McCarthy, Jr.
6,728,606 B2 4/2004 Kumar
6,728,625 B2 4/2004 Strubhar et al.
6,732,023 B2 5/2004 Sugita et al.
6,732,032 B1 5/2004 Banet et al.
6,748,303 B2 6/2004 Hawthorne
6,748,313 B2 6/2004 Li et al.
6,763,291 B1 7/2004 Houpt et al.
6,782,044 B1 8/2004 Wright et al.
6,789,005 B2 9/2004 Hawthorne
6,799,096 B1 9/2004 Franke et al.
6,804,621 B1 10/2004 Pedanckar
6,810,312 B2 10/2004 Jammu et al.
6,812,888 B2 11/2004 Drury et al.
6,814,050 B2 11/2004 Kishibata et al.
6,814,060 B1 11/2004 Solomons et al.
6,853,888 B2 2/2005 Kane et al.
6,853,890 B1 2/2005 Horst et al.
6,854,691 B2 2/2005 Kraeling et al.
6,863,246 B2 3/2005 Kane et al.

(56) References Cited

U.S. PATENT DOCUMENTS 6,865,454 B2 3/2005 Kane et al.
6,893,262 B2 5/2005 Stockman
6,903,658 B2 6/2005 Kane et al.
6,904,110 B2 6/2005 Trans et al.
6,910,792 B2 6/2005 Takada et al.
6,915,191 B2 7/2005 Kane et al.
6,947,830 B1 9/2005 Froloff et al.
6,948,837 B2 9/2005 Suzuki
6,953,272 B2 10/2005 Hayakawa et al.
6,957,131 B2 10/2005 Kane et al.
6,973,947 B2 12/2005 Penaloza et al.
6,980,894 B1 12/2005 Gordon et al.
6,996,461 B2 2/2006 Kane et al.
7,031,823 B2 4/2006 Chatfield et al.
7,047,130 B2 5/2006 Watanabe et al.
7,051,693 B2 5/2006 Tetsuno et al.
7,072,757 B2 7/2006 Adams et al.
7,082,924 B1 8/2006 Ruedin
7,096,171 B2 8/2006 Hawthorne et al.
7,131,403 B1 11/2006 Banga et al.
7,140,477 B2 11/2006 Engle et al.
7,161,500 B2 1/2007 Alfredsson et al.
7,188,009 B2 3/2007 Hawthorne
7,200,536 B2 4/2007 Wynn
7,219,067 B1 5/2007 McMullen et al.
7,234,449 B2 6/2007 Casablanca et al.
7,263,647 B2 8/2007 Bryant et al.
7,290,807 B2 11/2007 Kumar
7,309,929 B2 12/2007 Donnelly et al.
7,337,766 B2 3/2008 Nakayama et al.
7,387,029 B2 6/2008 Cunningham
7,389,694 B1 6/2008 Hay et al.
7,395,141 B1 7/2008 Seck et al.
7,416,262 B2 8/2008 Ring
7,497,201 B2 3/2009 Hollenbeck
7,509,193 B2 3/2009 Kustosch
7,523,893 B2 4/2009 Francis et al.
7,557,748 B1 7/2009 Zahm et al.
7,565,867 B2 7/2009 Donnelly et al.
7,667,611 B2 2/2010 Lindsey et al.
7,734,387 B1 6/2010 Young et al.
7,770,847 B1 8/2010 Severson
7,778,747 B2 8/2010 Hawkins et al.
7,783,397 B2 8/2010 Peltz et al.
7,811,089 B2 10/2010 Bond
7,895,135 B2 2/2011 Norris et al.
7,960,855 B2 6/2011 King et al.
8,030,871 B1 10/2011 Young et al.
8,068,975 B2 11/2011 Jensen et al.
8,126,601 B2 2/2012 Kapp et al.
8,150,568 B1 4/2012 Gray
8,154,227 B1 4/2012 Young et al.
8,155,811 B2 4/2012 Noffsinger et al.
8,157,218 B2 4/2012 Riley et al.
8,157,219 B2 4/2012 Ashraf et al.
8,160,832 B2 4/2012 Luo et al.
8,195,364 B2 6/2012 Norris et al.
8,264,330 B2 9/2012 Yeldell et al.
8,266,092 B2 9/2012 Kuhn et al.
8,305,567 B2 11/2012 Hesser et al.
8,428,798 B2 4/2013 Kull
8,521,345 B2 8/2013 Cooper et al.
8,532,842 B2 9/2013 Smith et al.
8,626,366 B2 1/2014 Noffsinger et al.
8,645,047 B2 2/2014 Daum et al.
8,655,518 B2 2/2014 Cooper et al.
8,655,519 B2 2/2014 Cooper et al.
9,162,691 B2 10/2015 Polivka et al.
2001/0001131 A1 5/2001 Miller
2001/0026321 A1 10/2001 Goto
2001/0047241 A1 11/2001 Khavakh et al.
2002/0010531 A1 1/2002 Hawthorne et al.
2002/0049520 A1* 4/2002 Mays ..... B61L 15/0027 701/19
2002/0059075 A1 5/2002 Schick et al.
2002/0062819 A1 5/2002 Takahashi
2002/0065698 A1 5/2002 Schick et al.
2002/0072833 A1 6/2002 Gray
2002/0096081 A1 7/2002 Kraft
2002/0103585 A1 8/2002 Biess et al.
2002/0104779 A1 8/2002 Connor et al.
2002/0107618 A1 8/2002 Deguchi et al.
2002/0157901 A1 10/2002 Kast et al.
2002/0162536 A1 11/2002 Steinbrenner et al.
2002/0174653 A1 11/2002 Uzkan
2002/0188397 A1 12/2002 Biess et al.
2002/0195086 A1 12/2002 Beck et al.
2003/0000499 A1 1/2003 Doelker et al.
2003/0034423 A1 2/2003 Hess, Jr. et al.
2003/0055666 A1 3/2003 Roddy et al.
2003/0060968 A1 3/2003 MacPhail et al.
2003/0076221 A1 4/2003 Akiyama et al.
2003/0091017 A1 5/2003 Davenport et al.
2003/0104899 A1 6/2003 Keller
2003/0105561 A1 6/2003 Nickles et al.
2003/0107548 A1 6/2003 Eun et al.
2003/0120400 A1 6/2003 Ahmed Baig et al.
2003/0139909 A1 7/2003 Ozawa
2003/0158640 A1 8/2003 Pillar et al.
2003/0183729 A1 10/2003 Root et al.
2003/0187694 A1 10/2003 Rowen
2003/0213875 A1 11/2003 Hess, Jr. et al.
2003/0214417 A1 11/2003 Peltz et al.
2003/0222981 A1 12/2003 Kisak et al.
2003/0229097 A1 12/2003 Watkins et al.
2003/0229446 A1 12/2003 Boscamp et al.
2003/0233959 A1 12/2003 Kumar
2003/0236598 A1 12/2003 Villarreal Antelo et al.
2004/0010432 A1 1/2004 Matheson et al.
2004/0024515 A1 2/2004 Troupe et al.
2004/0024518 A1 2/2004 Boley et al.
2004/0025849 A1 2/2004 West et al.
2004/0026574 A1 2/2004 Seifert
2004/0034556 A1 2/2004 Matheson et al.
2004/0038831 A1 2/2004 Eadie
2004/0048620 A1 3/2004 Nakahara et al.
2004/0049339 A1 3/2004 Kober et al.
2004/0068359 A1 4/2004 Neiss et al.
2004/0073361 A1 4/2004 Tzamaloukas et al.
2004/0075280 A1 4/2004 Kumar et al.
2004/0098142 A1 5/2004 Warren et al.
2004/0107042 A1 6/2004 Seick
2004/0108814 A1 6/2004 Tsuda et al.
2004/0129289 A1 7/2004 Hafemann
2004/0129840 A1 7/2004 Horst
2004/0133315 A1 7/2004 Kumar et al.
2004/0143374 A1 7/2004 Horst et al.
2004/0153221 A1 8/2004 Kumar
2004/0167687 A1 8/2004 Kornick et al.
2004/0172175 A1 9/2004 Julich et al.
2004/0174121 A1 9/2004 Tsuda et al.
2004/0238693 A1 12/2004 Cole
2004/0243664 A1 12/2004 Horstemeyer
2004/0245410 A1 12/2004 Kisak et al.
2004/0249571 A1 12/2004 Blesener et al.
2005/0004723 A1 1/2005 Duggan et al.
2005/0007020 A1 1/2005 Tsuda et al.
2005/0045058 A1 3/2005 Donnelly et al.
2005/0055157 A1 3/2005 Scholl
2005/0055287 A1 3/2005 Schmidtberg et al.
2005/0065674 A1 3/2005 Houpt et al.
2005/0065711 A1 3/2005 Dahlgren et al.
2005/0076716 A1 4/2005 Turner
2005/0090978 A1 4/2005 Bathory et al.
2005/0096797 A1 5/2005 Matsubara et al.
2005/0099323 A1 5/2005 Hirose
2005/0107954 A1 5/2005 Nahla
2005/0109882 A1 5/2005 Armbruster et al.
2005/0120904 A1 6/2005 Kumar et al.
2005/0121005 A1 6/2005 Edwards
2005/0121971 A1 6/2005 Ring
2005/0133673 A1 6/2005 Sugita et al.
2005/0171655 A1 8/2005 Flynn et al.
2005/0171657 A1 8/2005 Kumar

(56) References Cited

U.S. PATENT DOCUMENTS

2005/0186325 A1 8/2005 Luangthep
2005/0188745 A1 9/2005 Staphanos et al.
2005/0189815 A1 9/2005 Bryant
2005/0189886 A1 9/2005 Donnelly et al.
2005/0192720 A1 9/2005 Christie et al.
2005/0196737 A1 9/2005 Mann
2005/0205719 A1 9/2005 Hendrickson et al.
2005/0210304 A1 9/2005 Hartung et al.
2005/0229604 A1 10/2005 Chen
2005/0251299 A1 11/2005 Donnelly et al.
2005/0253397 A1 11/2005 Kumar et al.
2005/0285552 A1 12/2005 Grubba et al.
2005/0288832 A1 12/2005 Smith et al.
2006/0005736 A1 1/2006 Kumar
2006/0025903 A1 2/2006 Kumar
2006/0030978 A1 2/2006 Rajaram
2006/0047379 A1 3/2006 Schullian et al.
2006/0055175 A1 3/2006 Grinblat
2006/0060345 A1 3/2006 Flik et al.
2006/0076461 A1 4/2006 Derose et al.
2006/0085103 A1 4/2006 Smith, Jr. et al.
2006/0085363 A1 4/2006 Cheng et al.
2006/0086546 A1 4/2006 Hu et al.
2006/0116789 A1 6/2006 Subramanian et al.
2006/0116795 A1 6/2006 Abe et al.
2006/0122737 A1 6/2006 Tani et al.
2006/0129289 A1 6/2006 Kumar et al.
2006/0138285 A1 6/2006 Oleski et al.
2006/0162973 A1 7/2006 Harris et al.
2006/0173596 A1* 8/2006 Hohmann ..... B60G 17/0165 701/38
2006/0178800 A1 8/2006 Chen et al.
2006/0187086 A1 8/2006 Quintos
2006/0212188 A1 9/2006 Kickbusch et al.
2006/0212189 A1 9/2006 Kickbusch et al.
2006/0219214 A1 10/2006 Okude et al.
2006/0225710 A1 10/2006 Taglialatela-Scafati et al.
2006/0231066 A1 10/2006 Demura et al.
2006/0235584 A1 10/2006 Fregene et al.
2006/0235604 A1 10/2006 Taglialatela-Scafati et al.
2006/0253233 A1 11/2006 Metzger
2006/0271291 A1 11/2006 Meyer
2006/0277906 A1 12/2006 Burk et al.
2006/0282199 A1 12/2006 Daum et al.
2007/0006831 A1 1/2007 Leone et al.
2007/0061053 A1 3/2007 Zeitzew
2007/0062476 A1 3/2007 Ota et al.
2007/0073466 A1 3/2007 Tamai et al.
2007/0078026 A1 4/2007 Holt et al.
2007/0093148 A1 4/2007 Gibbs et al.
2007/0095589 A1 5/2007 Tamai et al.
2007/0108308 A1 5/2007 Keightley
2007/0112475 A1 5/2007 Koebler et al.
2007/0129852 A1 6/2007 Chen et al.
2007/0135988 A1 6/2007 Kidston et al.
2007/0137514 A1 6/2007 Kumar et al.
2007/0183039 A1 8/2007 Irvin
2007/0203203 A1 8/2007 Tao et al.
2007/0209619 A1 9/2007 Leone
2007/0219681 A1 9/2007 Kumar et al.
2007/0219682 A1 9/2007 Kumar et al.
2007/0219683 A1 9/2007 Daum et al.
2007/0225878 A1 9/2007 Kumar et al.
2007/0233364 A1 10/2007 Kumar et al.
2007/0236366 A1* 10/2007 Gur ..... G06K 9/00 340/945
2007/0241237 A1 10/2007 Foy et al.
2007/0250225 A1 10/2007 Nickles et al.
2007/0250255 A1 10/2007 Matekunas et al.
2007/0260367 A1 11/2007 Wills et al.
2007/0260369 A1 11/2007 Philp et al.
2007/0261648 A1 11/2007 Reckels et al.
2007/0274158 A1 11/2007 Agam et al.
2008/0004721 A1 1/2008 Huff et al.
2008/0041267 A1 2/2008 Denen et al.
2008/0065282 A1 3/2008 Daum et al.
2008/0091334 A1 4/2008 Carlson et al.
2008/0105791 A1* 5/2008 Karg ..... B61K 9/10 246/120
2008/0109124 A1 5/2008 Daum et al.
2008/0110249 A1 5/2008 Degeorge et al.
2008/0125924 A1 5/2008 Daum et al.
2008/0128563 A1 6/2008 Kumar et al.
2008/0147256 A1 6/2008 Liberatore
2008/0161984 A1 7/2008 Hrdlicka et al.
2008/0164078 A1 7/2008 Rhodes et al.
2008/0183345 A1 7/2008 Chandra et al.
2008/0183490 A1 7/2008 Martin et al.
2008/0201019 A1 8/2008 Kumar et al.
2008/0201028 A1 8/2008 Brooks et al.
2008/0201056 A1 8/2008 Moriya
2008/0208393 A1 8/2008 Schricker
2008/0312775 A1 12/2008 Kumar
2009/0044530 A1 2/2009 Gallagher et al.
2009/0063045 A1 3/2009 Figueroa et al.
2009/0076664 A1 3/2009 McCabe et al.
2009/0078236 A1 3/2009 Gallagher et al.
2009/0140574 A1 6/2009 Gorman et al.
2009/0159046 A1 6/2009 Moriya
2009/0164104 A1 6/2009 Wermuth et al.
2009/0177345 A1 7/2009 Severinsky et al.
2009/0186325 A1 7/2009 Kumar
2009/0187291 A1 7/2009 Daum et al.
2009/0193899 A1 8/2009 Panetta et al.
2009/0198391 A1 8/2009 Kumar et al.
2009/0205028 A1 8/2009 Smeets et al.
2009/0241909 A1 10/2009 Smith
2009/0248220 A1 10/2009 Ecton et al.
2009/0254239 A1 10/2009 Daum et al.
2009/0266943 A1 10/2009 Kumar et al.
2009/0299555 A1 12/2009 Houpt et al.
2009/0319092 A1 12/2009 Piche
2010/0023190 A1 1/2010 Kumar et al.
2010/0023240 A1 1/2010 Haskara et al.
2010/0049384 A1 2/2010 Kraeling et al.
2010/0049408 A1 2/2010 Abadie et al.
2010/0084916 A1 4/2010 Kumar et al.
2010/0114404 A1 5/2010 Donnelly
2010/0130124 A1 5/2010 Teeter et al.
2010/0131130 A1 5/2010 Kalyanam et al.
2010/0152998 A1 6/2010 Schwarzmann
2010/0174427 A1 7/2010 Sivasubramaniam et al.
2010/0235022 A1 9/2010 Siddappa et al.
2010/0262321 A1 10/2010 Daum et al.
2010/0318247 A1 12/2010 Kumar
2010/0332058 A1 12/2010 Kane et al.
2011/0029243 A1 2/2011 Gallagher et al.
2011/0035138 A1 2/2011 Kickbusch et al.
2011/0060486 A1 3/2011 Meltser et al.
2011/0093144 A1 4/2011 Goodermuth et al.
2011/0118899 A1 5/2011 Brooks et al.
2011/0257869 A1 10/2011 Kumar et al.
2011/0284700 A1 11/2011 Brand et al.
2011/0307113 A1 12/2011 Kumar et al.
2011/0313671 A1* 12/2011 Nedilko ..... B61K 9/08 702/14
2012/0022728 A1 1/2012 Hall et al.
2012/0108204 A1 5/2012 Schell et al.
2012/0108205 A1 5/2012 Schell et al.
2012/0108207 A1 5/2012 Schell et al.
2012/0135710 A1 5/2012 Schell et al.
2012/0197504 A1 8/2012 Sujan et al.
2012/0217351 A1 8/2012 Chadwick et al.
2012/0245766 A1 9/2012 Cooper et al.
2012/0245770 A1 9/2012 Yamamoto et al.
2012/0277940 A1 11/2012 Kumar et al.
2012/0290185 A1 11/2012 Cooper et al.
2012/0296545 A1 11/2012 Cooper et al.
2012/0316717 A1 12/2012 Daum et al.
2013/0015298 A1 1/2013 Cooper et al.
2013/0035811 A1 2/2013 Schroeck et al.
2013/0062474 A1 3/2013 Baldwin et al.
2013/0110328 A1 5/2013 Falk et al.
2013/0131909 A1 5/2013 Cooper et al.

(56) References Cited

U.S. PATENT DOCUMENTS

| | | | |
|---|---|---|---|
| 2013/0169037 | A1 | 7/2013 | Bieg et al. |
| 2013/0171590 | A1 | 7/2013 | Kumar |
| 2013/0173083 | A1 | 7/2013 | Cooper et al. |
| 2013/0261837 | A1 | 10/2013 | Sharma et al. |
| 2013/0261856 | A1 | 10/2013 | Sharma et al. |
| 2013/0317676 | A1* | 11/2013 | Cooper ..... B61L 3/121 701/20 |
| 2013/0334373 | A1 | 12/2013 | Malone, Jr. et al. |
| 2014/0094998 | A1 | 4/2014 | Cooper et al. |
| 2014/0129154 | A1 | 5/2014 | Cooper et al. |
| 2014/0156123 | A1 | 6/2014 | Cooper et al. |
| 2014/0277824 | A1 | 9/2014 | Kernwein et al. |
| 2014/0280899 | A1 | 9/2014 | Brewster, Jr. et al. |
| 2015/0009331 | A1 | 1/2015 | Venkatraman |
| 2015/0070503 | A1 | 3/2015 | Kraeling et al. |
| 2015/0081214 | A1 | 3/2015 | Cooper et al. |

FOREIGN PATENT DOCUMENTS

| | | | |
|---|---|---|---|
| AU | 2010256020 | A1 | 12/2011 |
| CA | 1065039 | A1 | 10/1979 |
| CA | 2192151 | A1 | 8/1997 |
| CA | 2627074 | A1 | 5/2007 |
| CH | 642418 | A5 | 4/1984 |
| CN | 1511744 | A | 7/2004 |
| CN | 1528631 | A | 9/2004 |
| CN | 1636814 | A | 7/2005 |
| CN | 1683914 | A | 10/2005 |
| CN | 1819942 | A | 8/2006 |
| CN | 1906074 | A | 1/2007 |
| CN | 1958363 | A | 5/2007 |
| CN | 101351373 | A | 1/2009 |
| CN | 101412377 | A | 4/2009 |
| CN | 102556118 | B | 6/2014 |
| DE | 1605862 | A1 | 5/1971 |
| DE | 129761 | A1 | 2/1978 |
| DE | 208324 | A1 | 5/1984 |
| DE | 3538165 | A1 | 4/1987 |
| DE | 255132 | A1 | 3/1988 |
| DE | 4225800 | C1 | 11/1993 |
| DE | 19645426 | A1 | 5/1997 |
| DE | 19654960 | A1 | 7/1998 |
| DE | 19731643 | A1 | 9/1998 |
| DE | 19726542 | A1 | 11/1998 |
| DE | 19830053 | C1 | 11/1999 |
| DE | 19826764 | A1 | 12/1999 |
| DE | 19935349 | A1 | 2/2001 |
| DE | 19935352 | A1 | 2/2001 |
| DE | 19935353 | A1 | 2/2001 |
| DE | 10045921 | A1 | 3/2002 |
| DE | 10226143 | B4 | 2/2006 |
| DE | 102005051077 | A1 | 4/2007 |
| DE | 202010006811 | U1 | 7/2010 |
| DE | 102010026433 | A1 | 1/2012 |
| DE | 102010045234 | A1 | 3/2012 |
| DE | 102013219763 | A1 | 8/2014 |
| EP | 0088716 | A2 | 9/1983 |
| EP | 0114633 | A1 | 8/1984 |
| EP | 0341826 | A2 | 11/1989 |
| EP | 0445047 | A1 | 9/1991 |
| EP | 0467377 | A2 | 1/1992 |
| EP | 0485978 | A1 | 5/1992 |
| EP | 0539885 | A2 | 5/1993 |
| EP | 0554983 | A1 | 8/1993 |
| EP | 0594226 | A2 | 4/1994 |
| EP | 0644098 | A2 | 3/1995 |
| EP | 0719690 | A2 | 7/1996 |
| EP | 0755840 | A1 | 1/1997 |
| EP | 0958987 | A2 | 11/1999 |
| EP | 1034984 | A2 | 9/2000 |
| EP | 1143140 | A1 | 10/2001 |
| EP | 1253059 | A1 | 10/2002 |
| EP | 1293948 | A2 | 3/2003 |
| EP | 1297982 | A2 | 4/2003 |
| EP | 1348854 | A1 | 10/2003 |
| EP | 1466803 | A1 | 10/2004 |
| EP | 1562321 | A2 | 8/2005 |
| EP | 1564395 | A2 | 8/2005 |
| EP | 1566533 | A1 | 8/2005 |
| EP | 1754644 | A1 | 2/2007 |
| EP | 1816332 | A1 | 8/2007 |
| FR | 2129215 | A5 | 10/1972 |
| FR | 2558806 | A1 | 8/1985 |
| FR | 2767770 | A1 | 3/1999 |
| GB | 482625 | A | 4/1938 |
| GB | 1321053 | A | 6/1973 |
| GB | 1321054 | A | 6/1973 |
| GB | 2188464 | A | 9/1987 |
| GB | 2371121 | A | 7/2002 |
| GB | 2414816 | A | 12/2005 |
| JP | 52121192 | A | 10/1977 |
| JP | 63268405 | A | 11/1988 |
| JP | 03213459 | A | 9/1991 |
| JP | 0532733 | A | 2/1993 |
| JP | 0561347 | A | 3/1993 |
| JP | 0577734 | A | 3/1993 |
| JP | 05238392 | A | 9/1993 |
| JP | 05278615 | A | 10/1993 |
| JP | 0628153 | A | 2/1994 |
| JP | 06108869 | A | 4/1994 |
| JP | 06153327 | A | 5/1994 |
| JP | 07132832 | A | 5/1995 |
| JP | 08198102 | A | 8/1996 |
| JP | 0976913 | A | 3/1997 |
| JP | 09193804 | A | 7/1997 |
| JP | 09200910 | A | 7/1997 |
| JP | 10274075 | A | 10/1998 |
| JP | 112558 | A | 1/1999 |
| JP | 2858529 | B2 | 2/1999 |
| JP | 2001065360 | A | 3/2001 |
| JP | 2002204507 | A | 7/2002 |
| JP | 2002249049 | A | 9/2002 |
| JP | 2002294609 | A | 10/2002 |
| JP | 2003095109 | A | 4/2003 |
| JP | 2004301080 | A | 10/2004 |
| JP | 2004328993 | A | 11/2004 |
| JP | 2005002802 | A | 1/2005 |
| JP | 2006219051 | A | 8/2006 |
| JP | 2006320139 | A | 11/2006 |
| JP | 2006327551 | A | 12/2006 |
| JP | 2008535871 | A | 9/2008 |
| JP | 2009095094 | A | 4/2009 |
| KZ | 386 | U | 8/2008 |
| RU | 2115140 | C1 | 7/1998 |
| RU | 2207279 | C1 | 6/2003 |
| RU | 2213669 | C1 | 10/2003 |
| RU | 2233011 | C2 | 7/2004 |
| RU | 2237589 | C1 | 10/2004 |
| RU | 2238860 | C1 | 10/2004 |
| RU | 2238869 | C1 | 10/2004 |
| RU | 2242392 | C2 | 12/2004 |
| RU | 2265539 | C2 | 12/2005 |
| RU | 2272731 | C2 | 3/2006 |
| RU | 2273567 | C1 | 4/2006 |
| RU | 2286279 | C2 | 10/2006 |
| RU | 2299144 | C2 | 5/2007 |
| RU | 2320498 | C1 | 3/2008 |
| RU | 83221 | U1 | 5/2009 |
| SU | 568241 | A1 | 12/1981 |
| WO | 9003622 | A1 | 4/1990 |
| WO | 9525053 | A1 | 9/1995 |
| WO | 9606766 | A1 | 3/1996 |
| WO | 9858829 | A1 | 12/1998 |
| WO | 9914090 | A1 | 3/1999 |
| WO | 9960735 | A1 | 11/1999 |
| WO | 0186139 | A1 | 11/2001 |
| WO | 03097424 | A1 | 11/2003 |
| WO | 2004023517 | A1 | 3/2004 |
| WO | 2004039621 | A1 | 5/2004 |
| WO | 2004051699 | A2 | 6/2004 |
| WO | 2004051700 | A2 | 6/2004 |
| WO | 2004052755 | A1 | 6/2004 |
| WO | 2004059446 | A2 | 7/2004 |

(56) References Cited

FOREIGN PATENT DOCUMENTS

| | | | |
|---|---|---|---|
| WO | 2005028837 | A2 | 3/2005 |
| WO | 2006049252 | A1 | 5/2006 |
| WO | 2006133306 | A1 | 12/2006 |
| WO | 2007027130 | A1 | 3/2007 |
| WO | 2007091270 | A2 | 8/2007 |
| WO | 2007116123 | A1 | 10/2007 |
| WO | 2008065032 | A1 | 6/2008 |
| WO | 2008073547 | A2 | 6/2008 |
| WO | 2009092218 | A1 | 7/2009 |
| WO | 2010039680 | A1 | 4/2010 |
| WO | 2010139489 | A1 | 12/2010 |
| WO | 2012041978 | A2 | 4/2012 |
| WO | 2014193610 | A1 | 12/2014 |
| ZA | 200101708 | B | 8/2001 |

OTHER PUBLICATIONS

International Preliminary Report on Patentability issued in connection with Related PCT Application No. PCT/US2013/071237 dated May 26, 2015.
U.S. Non-Final Office Action issued in Connection with Related U.S. Appl. No. 14/221,624 dated Jun. 19, 2015.
U.S. Non-Final Office Action issued in Connection with Related U.S. Appl. No. 14/527,246 dated Sep. 22, 2015.
U.S. Final Office Action issued in Connection with Related U.S. Appl. No. 14/221,624 dated Oct. 5, 2015.
U.S. Non-Final Office Action issued in Connection with Related U.S. Appl. No. 13/939,326 dated Oct. 9, 2015.
U.S. Non-Final Office Action issued in Connection with Related U.S. Appl. No. 14/657,233 dated Nov. 18, 2015.
U.S. Non-Final Office Action issued in Connection with Related U.S. Appl. No. 14/679,217 dated Dec. 17, 2015.
Unofficial English Translation of Chinese Office Action issued in connection with Related CN Application No. 201380071077.1 dated Feb. 6, 2016.
U.S. Notice of Allowance issued in Connection with Related U.S. Appl. No. 14/527,246 dated Feb. 23, 2016.
U.S. Final Office Action issued in Connection with Related U.S. Appl. No. 14/657,233 dated Mar. 18, 2016.
U.S. Final Office Action issued in Connection with Related U.S. Appl. No. 14/679,217 dated Apr. 15, 2016.
U.S. Non-Final Office Action issued in Connection with Related U.S. Appl. No. 14/221,624 dated Jun. 1, 2016.
PCT Search Report and Written Opinion issued in Connection with Related PCT Application No. PCT/US2016/021925 dated Jun. 23, 2016.
U.S. Notice of Allowance issued in Connection with Related U.S. Appl. No. 14/527,246 dated Jun. 27, 2016.
Australian Office Action issued in Connection with Related AU Application No. 2013299945 dated Aug. 8, 2016.
PCT Search Report and Written Opinion issued in Connection with Related PCT Application No. PCT/US2016/031444 dated Aug. 24, 2016.
U.S. Non-Final Office Action issued in Connection with Related U.S. Appl. No. 14/657,233 dated Sep. 7, 2016.
Australian Office Action issued in Connection with Related AU Application No. 2013299501 dated Oct. 7, 2016.
European Search Report and Opinion issued in Connection with Related EP Application No. 16170151.1 dated Oct. 21, 2016.
U.S. Notice of Allowance issued in Connection with Related U.S. Appl. No. 14/679,217 dated Oct. 24, 2016.
European Search Report and Opinion issued in Connection with Related EP Application No. 13856206.1 dated Nov. 11, 2016.
Australian Office Action issued in Connection with Related AU Application No. 2015201894 dated Dec. 13, 2016.
European Search Report and Opinion issued in Connection with Related EP Application No. 16186434.3 dated Jan. 17, 2017.
Australian Office Action issued in Connection with Related AU Application No. 2016203027 dated Jan. 18, 2017.
U.S. Notice of Allowance issued in Connection with Related U.S. Appl. No. 14/657,233 dated Jan. 27, 2017.
Australian Notice of Acceptance issued in Connection with Related AU Application No. 2013299501 dated Feb. 27, 2017.
US Non-Final Office Action issued in Connection with Related U.S. Appl. No. 14/841,209 dated Feb. 28, 2017.
U.S. Non-Final Office Action issued in Connection with Related U.S. Appl. No. 15/044,592 dated Mar. 9, 2017.
Krevitt., "Remote Maintenance Techniques for the 200-BEV Accelerator", IEEE Transactions on Nuclear Science, vol. No. 14, Issue No. 03, pp. 997-1003, Jun. 1967.
Kiersztyn et al., "Evaluation of Locomotive Cable Insulation Life Under Varying Temperature Loading", IEEE Transactions on Industry Applications, vol. No. IA-21, Issue No. 04, pp. 882-888, Jul./Aug. 1985.
Hoyt et al., "Assessing the Effects of Several Variables on Freight Train Fuel Consumption and Performance using a Train Performance Simulator", Transportation Research, vol. No. 24A, Issue No. 02, pp. 99-112, Jan. 1, 1990.
Hooper., "Reducing Rail Costs Through Innovative Methods", Railway Track and Structures, pp. 14-17, Jul. 1993.
Grizzle et al., "Improved Cylinder Air Charge Estimation for Transient Air Fuel Ratio Control", Proceedings of the American Control Conference, Maryland, vol. No. 02, pp. 1568-1573, Jun. 29, 1994.
Grabs., "Conflict Detection and Resolution for Disposable Tasks in Company Centers", Conversion in ESTW/Automation of the Disposition, Issue No. 05, pp. 254-258, Jul. 1995.
Chiang et al., "Cycle Detection in Repair-Based Railway Scheduling System", Proceedings of the 1996 IEEE International Conference on Robotics and Automation Minneapolis, New York, USA, vol. No. 3, pp. 2517-2522, Apr. 22, 1996.
Bonissone et al., "Genetic Algorithms for Automated Tuning of Fuzzy Controllers: A Transportation Application", Proceedings of the Fifth IEEE International Conference on Fuzzy Systems, Schenectady, USA, vol. No. 01, pp. 574-680, Sep. 8-11, 1996.
Cheng., "Hybrid Simulation for Resolving Resource Conflicts in Train Traffic Rescheduling", Computers in Industry, vol. No. 35, Issue No. 3, pp. 233-246, Apr. 1, 1998.
Razouqi et al., "RYNSORD: A Novel, Decentralized Algorithm for Railway Networks with 'Soft Reservation'" , VTC 98, 48th IEEE Ottawa, Canada, vol. No. 03, pp. 2585-2589, May 18-21, 1998.
Ehsani et al., "Application of Electrically Peaking hybrid (ELPH) Propulsion System to a Full-Size Passenger Car with Simulated Design Verification", IEEE Transactions on Vehicular Technology, vol. No. 48, Issue No. 06, pp. 1779-1787, Nov. 1999.
Cheng et al., "Algorithms on Optimal Driving Strategies for Train Control Problem", Proceedings of the 3rd World Congress on Intelligent Control and Automation, pp. 3523-3527, Jun. 28-Jul. 2, 2000.
He et al., "On-line Parameter Identification for Freight Train Systems", pp. 1-31, Aug. 29, 2000.
Franke et al., "An Algorithm for the Optimal Control of the Driving of Trains", Proceedings of the 39th IEEE Conference on Decision and Control, Sydney, Australia, pp. 2123-2127, Dec. 2000.
Dick et al., "Predicting the Occurrence of Broken Rails: A Quantitative Approach", In Proceedings of the American Railway Engineering and Maintenance of way Association Annual Conference, TX, USA, pp. 1-20, 2000.
Coleman., "A System for long Haul Optimal Driver Advice", Session 5b: Capacity Planning & Train Scheduling, pp. 5.61-5.69, 2003.
Dick et al., "Multivariate Statistical Model for Predicting Occurrence and Location of Broken Rails", Transportation Research Record: Journal of the Transportation Research Board, vol. No. 1825, Issue No. 01, pp. 48-55, 2003.
Salasoo., "Heavy Vehicle Systems Optimization Program: FY 2004 Annual Report", Section VIII.A. "21st Century Locomotive Technology" pp. 156-163, 2004.
"Technology Explained: The Common Rail Diesel Injection System", Robert Bosch GmbH, pp. 1-4, May 2004.

(56) References Cited

OTHER PUBLICATIONS

DOE, "21st Century Locomotive Technology-Quarterly Technical Status Report 6", Report No. DOE-AL68284-TSR06, pp. 1-10, Apr. to Jun. 2004.
Turner., "Feasibility of Locomotive-Mounted Broken Rail Detection", Final Report for High-Speed Rail IDEA Project 38, Transportation Research Board of the National Academies, pp. 1-37, Jun. 21, 2004.
Hou et al., "A Rail Damage Detection and Measurement System Using Neural Networks", IEEE International Conference on Computational Intelligence for Measurement Systems and Applications, CIMSA, Boston, MA, USA, pp. 4-9, Jul. 14-16, Jul. 2004.
Doe, "21st Century Locomotive Technology, Quarterly Technical Status Report 11", Report No. DOE-AL68284-TSR11, pp. 1-12, Jul. 2005 to Sep. 2005.
Chan et al., "Trip Optimizer System Description (Rev. 1.1)", Trip Optimizer for Freight Trains Functional Description, pp. 1-24, Nov. 16, 2005.
Ditmeyer., "Network Centric Railroading Utilizing Intelligent Railroad Systems", World Bank Transport Forum 2006 Rail Transport for Development, pp. 1-21, Mar. 31, 2006.
King et al., "DOE Heavy Vehicle Systems Optimization (peer review): 21st Century Locomotive Technology (Locomotive System Tasks)", 21st Century Locomotive Technology, pp. 1-20, Apr. 2006.
Brawner et al., "Magnetometer Sensor Feasibility for Railroad and Highway Equipment Detection", Final Report for High-Speed Rail IDEA Protect 53,Transportation Research Board of The National Academies, pp. 1-27, Jun. 24, 2006.
Chen et al., "Fault Detection and Diagnosis for Railway Track Circuits Using Neuro-Fuzzy Systems", Control Engineering Practice, vol. No. 16, pp. 585-596, May 2008.
Ho et al., "Signature Analysis on Wheel-Rail Interaction for Rail Defect Detection", Railway Condition Monitoring, 4th IET International Conference, Hong Kong, pp. 1-6, Jun. 2008.
Schafer II., "Effect of Train Length on Railroad Accidents and a Quantitative Analysis of Factors Affecting Broken Rails", Urbana Illinois, pp. 1-134, 2008.
Ghanbari et al., "Artificial Neural Networks and Regression Approaches Comparison for Forecasting Iran's Annual Electricity Load", Power Engineering, pp. 675-679, Mar. 18-20, 2009.
Xin-Yu et al., "The Research on the Mechanism of Limiting Speed Pick-Up and Set-Out Train on Railway Transportation Capacity Loss", Second International Conference on Intelligent Computation Technology and Automation, Changsha, China, vol. No. 03, pp. 830-833, 2009.
Xiaogang et al., "The Research and Application of 1089 t/h Circulating Fluidized Bed Unit Coordinate Control System", International Conference on E-Product E-Service and E-Entertainment (ICEEE), China, pp. 1-4, 2010.
Xun et al., "The Analysis of GSM-R Redundant Network and Reliability Models on High-Speed Railway", International Conference on Electronics and Information Engineering (ICEIE), Beijing, China, vol. No. 02, pp. V2-154-V2-158, 2010.
Patra et al., "Availability Analysis of Railway Track Circuits", Proceedings of the Institution of Mechanical Engineers, Part F: Journal of Rail and Rapid Transit, vol. No. 224, Issue No. 03, pp. 169-177, May 1, 2010.
Pan et al., "Full Process Control Strategy of Fuel Based on Water-Coal Ratio of Ultra Supercritical Units", Electronics Communications and Control (ICECC), IEEE International Conference, Guangzhou, China, pp. 3750-3753, 2011.
Shanthini et al., "Electromagnetic System for Railroad Track Crack Detection", British Journal of Science, vol. No. 4, Issue No. 01, pp. 49-56, Feb. 2012.
Kun-Peng et al., "Design of Transmission System of Real-Time Broken Rail Detection", Journal of Railway Science and Engineering, vol. No. 10, Issue No. 01, pp. 123-128, Feb. 2013.
Zhang et al., "Train Detection by Magnetic Field Sensing", Sensors and Materials, vol. No. 25, Issue No. 06, pp. 123-436, Feb. 4, 2013.
U.S. Non-Final Office Action issued in Connection with Related U.S. Appl. No. 13/954,096 dated Dec. 24, 2013.
PCT Search Report and Written Opinion issued in Connection with Related PCT Application No. PCT/US2013/054300 dated Feb. 10, 2014.
PCT Search Report and Written Opinion issued in Connection with Related PCT Application No. PCT/US2013/071237 dated Feb. 27, 2014.
PCT Invitation to Pay Additional Fees issued in Connection with Related PCT Application No. PCT/US2013/053124 dated Apr. 2, 2014.
U.S. Non-Final Office Action issued in Connection with Related U.S. Appl. No. 14/016,310 dated Apr. 22, 2014.
Knight, "10-4, Good Computer: Automated System Lets Trucks Convoy as One", MIT Technology Review, pp. 1-5, May 28, 2014.
PCT Search Report and Written Opinion issued in Connection with Related PCT Application No. PCT/U2013/053128 dated Jun. 23, 2014.
PCT Search Report and Written Opinion issued in Connection with Related PCT Application No. PCT/US2013/053124 dated Jul. 4, 2014.
U.S. Notice of Allowance issued in Connection with Related U.S. Appl. No. 14/016,310 dated Aug. 18, 2014.
Maldonado et al., "Autonomous Broken Rail Detection Technology for Use on Revenue Service Trains", U.S. Department of Transportation, Federal Railroad Administration, pp. 1-4, Dec. 2014.
Ariz., "Ridgetop Group Announces New Products for Rail Safety Improvements", Ridgetop Group Inc Engineering Innovation, pp. 1-2, May 18, 2015.
Joseph Forrest Noffsinger et al., Jul. 11, 2013, U.S. Appl. No. 13/939,326.
Jared Klineman Cooper et al., Jul. 30, 2013, U.S. Appl. No. 13/954,096.
Joseph Forrest Noffsinger et al., Mar. 21, 2014, U.S. Appl. No. 14/221,624.
Joseph Forrest Noffsinger et al., Mar. 19, 2016, U.S. Appl. No. 15/075,118.
Brett Alexander Matthews et al., Feb. 18, 2016, U.S. Appl. No. 15/047,083.
Yuri Alexeyevich Plotnikov et al., Aug. 31, 2015, U.S. Appl. No. 14/841,209.
Joseph Forrest Noffsinger et al., May 6, 2016, U.S. Appl. No. 15/148,570.
Sameh Fahmy, Feb. 16, 2016, U.S. Appl. No. 15/044,592.
Jared Klineman Cooper et al., Mar. 13, 2015, U.S. Appl. No. 14/657,233.
Joseph Forrest Noffsinger et al., Apr. 6, 2015, U.S. Appl. No. 14/679,217.
Jared Klineman Cooper et al., Jan. 15, 2014, U.S. Appl. No. 14/155,454.

* cited by examiner

VEHICLE CONTROL SYSTEM AND METHOD

CROSS-REFERENCE TO RELATED APPLICATIONS

This application claims priority to U.S. Provisional Application No. 62/134,518, which was filed on 17-Mar.-2015. This application also is a continuation-in-part of U.S. application Ser. No. 14/152,159, filed 10-Jan.-2014 and issued as U.S. Pat. No. 9,205,849 on 08-Dec.-2015, which is a continuation-in-part of U.S. application Ser. No. 13/478,388, filed 23-May-2012, now abandoned. This application also is a continuation-in-part of U.S. application Ser. No. 14/155,454, filed 15-Jan.-2014 (the "'454 Application") and issued as U.S. Pat. No. 9,671,358 on 06-Jun.-2017, and is a continuation-in-part of U.S. application Ser. No. 12/573,141, filed 04-Oct-2009 (the '141Application") and issued as U.S. Pat. No. 9,233,696 on 12-Jan.-2016. The '454 Application is a continuation of International Application No. PCT/US13/54284, which was filed on 9-Aug.-2013, and claims priority to U.S. Provisional Application No. 61/681,843, which was filed on 10-Aug.-2012, to U.S. Provisional Application No. 61/729,188, which was filed on 21-Nov.-2012, to U.S. Provisional Application No. 61/860,469, which was filed on 31-Jul.-2013, and to U.S. Provisional Application No. 61/860,496, which was filed on 31-Jul.-2013. The '141Application is a continuation-in-part of U.S. application Ser. No. 11/385,354, which was filed on 20-Mar.-2006. The entire disclosures of these applications are incorporated herein by reference.

FIELD

Embodiments of the subject matter described herein relate to systems and methods for vehicle control.

BACKGROUND

Vehicle systems, such as automobiles, mining equipment, rail vehicles, over-the-road truck fleets, and the like, may be operated, at least in part, by vehicle control systems. These vehicle control systems may perform under the manual instruction of an operator, may perform partly on manual input that is supplemented with some predetermined level of environmental awareness (such as anti-lock brakes that engage when a tire loses traction), or may perform entirely autonomously. Further, the vehicles may switch back and forth from one operating mode to another.

The vehicle system may not be used efficiently if the path over which it travels is in disrepair. For example, a train (including both a locomotive and a series of rail cars) may derail if the rails are not within designated specifications. Railroads may experience many derailments per year. In addition to the repair work to the rails, the resulting costs include network congestion, idled assets, lost merchandise, and the like. At least some derailments may be caused by, at least in part, faults in the track, bridge, or signal and in the mechanical aspects of the rail cars. Contributing aspects to derailments may include damaged or broken rails and wheels.

To reduce or prevent derailments, it has been prudent to conduct a periodic visual inspection of the track and of rail cars while in rail yards. Additionally, technology has been introduced that uses ultrasonic detection and lasers that may be mounted on hi-rail vehicles, track-geometry test cars, and wayside detectors (every 24 kilometers to 483 kilometers apart) that monitor freight car bearings, wheel impacts, dragging equipment, and hot wheels. This approach relies on the ability to maintain the track to be within tolerances so that operating a vehicle system on that track can be done in a consistent manner.

It may be desirable to have a system that differs from those that are currently available.

BRIEF DESCRIPTION

In one embodiment of the subject matter described herein, a system is provided that includes a controller operable to receive information from a plurality of discrete information sources and from a continuous monitoring system on-board a vehicle system, and the controller further is operable to control one or both of the speed and operation of the vehicle system.

In one embodiment, a method (e.g., for examining a route and/or vehicle system) includes obtaining one or more of a route parameter or a vehicle parameter from discrete examinations of one or more of a route or a vehicle system. The route parameter is indicative of a health of the route over which the vehicle system travels. The vehicle parameter is indicative of a health of the vehicle system. The discrete examinations of the one or more of the route or the vehicle system are separated from each other by one or more of location or time. The method also includes examining the one or more of the route parameter or the vehicle parameter to determine whether the one or more of the route or the vehicle system is damaged and, responsive to determining that the one or more of the route or the vehicle is damaged, continually monitoring the one or more of the route or the vehicle system.

In one embodiment, a system (e.g., an examination system) includes a controller and examination equipment. The controller is configured to obtain one or more of a route parameter or a vehicle parameter from discrete examinations of one or more of a route or a vehicle system. The route parameter is indicative of a health of the route over which the vehicle system travels. The vehicle parameter is indicative of a health of the vehicle system. The discrete examinations of the one or more of the route or the vehicle system are separated from each other by one or more of location or time. The controller is configured to examine the one or more of the route parameter or the vehicle parameter to determine whether the one or more of the route or the vehicle system is damaged. The examination equipment is configured to continually monitor the one or more of the route or the vehicle system responsive to determining that the one or more of the route or the vehicle is damaged. The system can complement, correlate with, and/or fill in monitoring or examination gaps of the discrete examinations collected by the controller.

BRIEF DESCRIPTION OF THE DRAWINGS

The subject matter described herein may be understood from reading the following description of non-limiting embodiments, with reference to the attached drawings, wherein.

DETAILED DESCRIPTION

Figure 1:
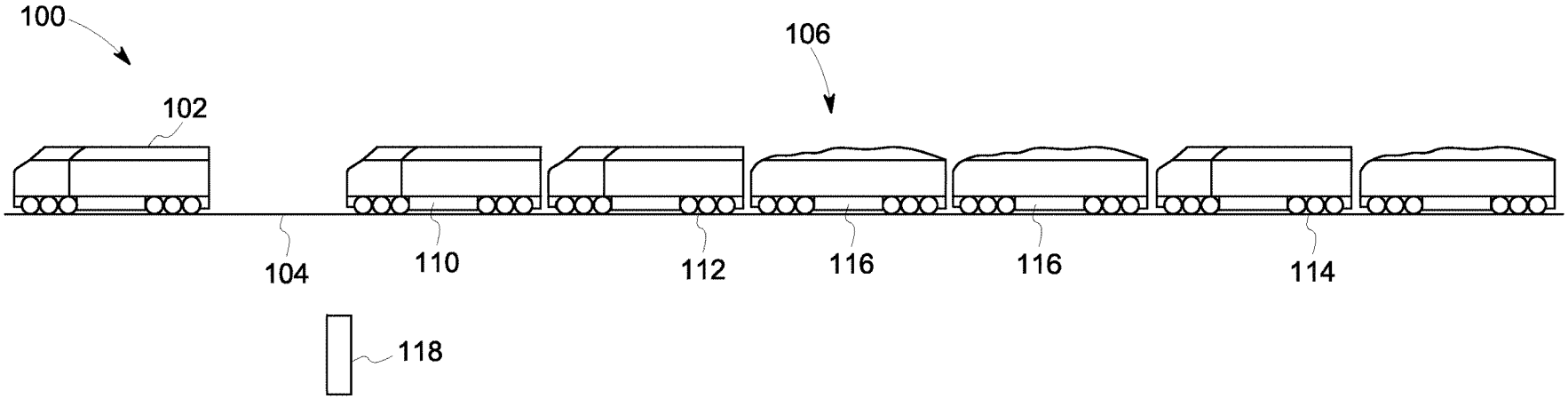
FIG. 1 is a schematic illustration of a vehicle system according to one example of the inventive subject matter.

One or more embodiments of the inventive subject matter described herein relate to a vehicle control system, and to methods of obtaining and using information from multiple sources to allow the vehicle control system to operate in a determined manner. While several examples of the inventive subject matter are described in terms of rail vehicles, not all embodiments of the inventive subject matter are limited to rail vehicles. At least some of the inventive subject matter may be used in connection with other vehicles, such as mining equipment, automobiles, marine vessels, airplanes, or the like. And, where appropriate, the term track may be interchanged with path, road, or the like.

Generally, by having track detection (rail and track geometry) mounted on a powered vehicle, with sensors mounted on each car mechanically or logically coupled to the powered vehicle and communicating therewith, the powered vehicle may be "aware" of an operational deviation or failure on either or both of the track or the coupled car component, and a vehicle control system of the vehicle can responsively initiate a new operating mode in which the powered vehicle changes its speed, direction, or some other operating parameter. In addition, the track and vehicle system status detection may be more continuous, and less discrete or segmented (either by time or by space, or by both time and space). And, analysis of historical data may provide prognostic information relating to a particular vehicle operating at a particular track location.

As used herein, the term continuous means generally without significant interruption. The term discrete means confined to a geography or to a period of time. For example, discrete examination of a route may refer to a measurement or other examination of the route that occurs during a finite time period that is separated (in terms of time and/or location) from other discrete examinations by a significantly longer period of time than the finite time period. In contrast, continuous examination may refer to a measurement or other examination of the route that extends over a longer period of time (e.g., during an entire trip of a vehicle system from a starting location to a final destination location of the trip), that is frequently repeated, or the like. In one embodiment, discrete examinations of the route may be separated in time and/or location such that the condition of the route may significantly change between the discrete examinations. For example, a first discrete examination of the route may not identify any crack, pitting, or the like, of the route, but a subsequent, second discrete examination of the route may identify one or more cracks, pits, or the like, at the same location along the route. In contrast, a continuous examination of the route may be frequently repeated and/or non-stop such that the changing condition of the route is detected as the route condition is changing (e.g., the examination may witness the damage to the route).

With reference to FIG. 1, a schematic illustration of an embodiment of an examination system 100 is shown. The system includes a test vehicle 102 disposed on a segment of route 104 leading a vehicle system 106. The route 104 can represent a track, road, or the like. The test vehicle 102 can represent a rail test vehicle and the vehicle system can represent a train. Optionally, the vehicle may be another type of vehicle, the track can be another type of route, and the train can represent a vehicle system formed from two or more vehicles traveling together along the route. The vehicle system includes a lead vehicle 110 and a trail vehicle 112 in a consist, and a remote vehicle 114 operating under a distributed power system, such as Locotrol Distributed Power available from GE Transportation. Between the trail vehicle and the remote vehicle are a plurality of cars 116. The vehicles and cars can represent locomotives and rail cars, but optionally can represent other types of vehicles. The vehicles 112, 114 may be referred to as propulsion-generating vehicles and the cars 116 may be referred to as non-propulsion-generating vehicles. A wayside unit 118 is disposed proximate to the route. The wayside unit is one of a plurality of such units (not shown) that are dispersed periodically along the route.

At least the lead vehicle has communication equipment that allows for data transmission with one or more other equipment sets off-board that vehicle. Suitable off-board equipment may include, as examples, cellular towers, Wi-Fi, wide area network (WAN) and Bluetooth enabled devices, communication satellites (e.g., low Earth orbiting or "LEO" satellites), other vehicles, and the like. These communication devices may then relay information to other vehicles or to a back office location. The information that is communicated may be in real time, near real time, or periodic. Periodic communications may take the form of "when available" uploads, for data storage devices that upload to a data repository when a communication pathway is opened to them. Also included are manual uploads, and the like, where the upload is accomplished by downloading the information to a USB drive or a computing device (smart phone, laptop, tablet and the like), and from that device communicating the information to the repository.

With regard to the test vehicle, the test vehicle may be run over the route at a certain frequency or in response to certain trigger conditions. Examination equipment 300 (shown in FIG. 3) onboard the test vehicle includes sensors that measure one or more parameters. The parameters can include route parameters, structure parameters, and/or environmental parameters. The route parameters may include level, grade, condition, spalling, gauge spread, and other forms of damage to the route. Structure parameters may further include information about the route bed and ballast, joints, the health of ties or sleepers, fasteners, switches, crossings, and the sub-grade. Environmental parameters may include information relating to proximate surroundings (such as brush or trees), or other such conditions on or near the route, grease or oil, leaves, snow and ice, water (particularly standing or flowing water on the tracks), sand or dirt build up, and the like.

The test vehicle may be land based on rails (as in the illustrated embodiment), but may be a hi-rail vehicle, may travel alongside the route (that is, wheeled), or may be airborne in the form of a drone, for example. The test vehicle may be a self-propelled vehicle, or the test vehicle may be manually run along the route such as, for example, the Sperry B-Scan Single Rail Walking Stick (available from Sperry Rail Service, a Rockwood Company) or pulled by a powered vehicle. The examination equipment 300 onboard the test vehicle may use video, laser, x-ray, electric induction, and/or ultrasonics to test the route or a catenary line for faults, defects, wear, damage, or other conditions. For ease of discussion, all references to route will include a reference to catenary lines as appropriate. The test vehicle may include a location device (such as a global positioning system receiver) so that the segment of the route being tested at a discrete point in time and location can result in a route profile.

The locomotive may include a location device and sensors that detect operational information from the locomotive. In such a way, for example, an impact sensor on the locomotive may record an impact event at a known time and location. This may indicate, among other things, a fault, defect, wear or damage (or another condition) of the track. Alternatively, the detected event may be associated with, for example, a wheel and not the track. A wheel with a flat spot, or that is out of alignment, or that has some other defect associated with it may be identified by sensors on board the locomotive. The locomotive may include the communication device that allows such information to be communicated to a back office, and may include a controller that may analyze the information and may suggest to the locomotive operator or may directly control the operation of the locomotive in response to an analysis of the information.

The rail car may include sensors that, like the locomotive, detect events associated with the track, a catenary line, the rail car, or both. Further, communication devices may be mounted on or near the rail car sensors. In one embodiment, these communication devices may be powerful enough to communicate over a distance and directly port sensor data to an off-board receiver. In another embodiment, the rail car communication devices are able to feed data to one or more locomotives. The communication feed through may be wired (for example, the Ethernet over multiple unit (eMU) product from GE Transportation) or wireless. The locomotive may then store and/or transmit the data as desired.

The wayside detectors may include sensors that measure impact force, weight, weight distribution and the like for the passing train. Further, other sensors (e.g., infrared sensors) may track the bearings health and/or brake health, and the health and status of like propulsion components. In one example, a locked axle for an AC combo may heat up and the heat may be detected by a wayside monitor.

Figure 2:
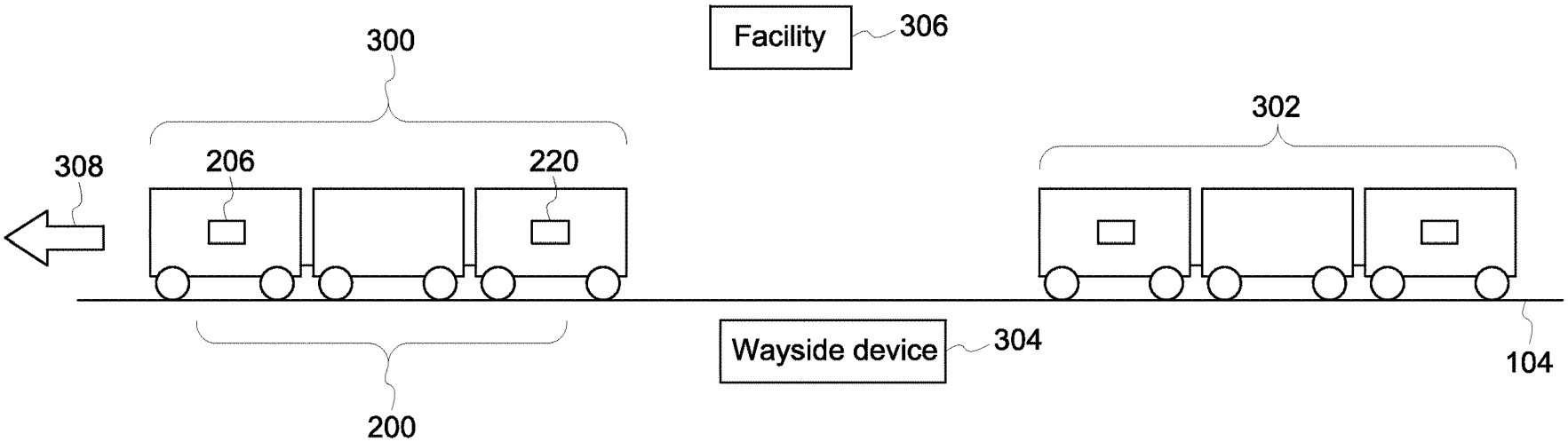
FIG. 2 is a schematic illustration of a vehicle system according to one example of the inventive subject matter.

With reference to FIG. 2, a segment of track 200 is occupied by a first train set 300 that includes a lead vehicle having an inductance based broken rail detection system 206 and a trail vehicle that has an impact sensor 220 that can sense the health of the rail tracks over which it runs. A second train set 302 is traveling on a different portion of the same track as the segment with the first train set. A wayside device 304 is disposed proximate to the track. A back office facility 306 is remote from the first train set, the second train set and the wayside device.

During operation, the broken rail detection system and the impact sensor can sense discontinuities in the track and/or in the wheels. That information is supplied to the locomotive powering the first train set (not shown), and is reported to the facility. The information from the wayside notes the health of the wheels and combos of the first train set as it passes the wayside device. The wayside device reports that information to the facility. There may be a period of time and/or distance prior to which the health of the wheels and combos of the first train set are not monitored by a wayside device. This may be due to the spacing of the wayside devices relative to each other along the route. Of note, just as the wayside devices may provide health information at discrete distances, if the route is checked by rail test vehicles periodically such health information is provided at discrete times. Further, the accuracy and reliability of the periodic rail test vehicle will diminish and degrade over time.

The locomotive, or powered vehicle, may be informed of the information from on-board sensors, as well as the historic data about the upcoming track from a rail test vehicle from one or more previous surveys of the track segment, and further with information from the wayside device or devices about the track segment and/or the wheel and/or combo health of the rail cars coupled to the locomotive. With this information, a controller in the locomotive may alter the operation of the locomotive in response to encountering a section of track in which there is a concern about the health or quality of the track, or in response to the health of a wheel or combo on a rail car in the train powered by the locomotive.

In one embodiment, the train may be traveling along the route according to a trip plan that designates operational settings of the train as a function of one or more of distance along the route or time. For example, the trip plan may dictate different speeds, throttle positions, brake settings, etc., for the train at different locations along the route. A locomotive pulling the first train set illustrated in FIG. 2 communicates with the facility and downloads data (learns) to the effect (for example) that the three previous rail test cars passing through a curve in an upcoming rail section detected that there were signs of the beginnings of cracks in the rails. The rails were still "in spec" when tested, but just barely, and further, there had been heavy traffic over that segment in the previous days since the last test. Further, the last wayside device noted rather severe flat spots on a damaged rail car towards the end of the mile-long first train set. The locomotive controller may then alter the trip plan in response to the information received from the various information sources. For example, the locomotive may slow down the entire first train set to navigate the curve in the track segment, and when the damaged rail car is set to enter the curve the locomotive may slow the first train set down to an even slower speed. The impact from the flat wheel spots at the slower speed may have a correspondingly lower chance of damaging the track at the curve, or of breaking either the track or the wheel set. After the first train set has cleared the curve and the track health is improved relative to the curve the locomotive may accelerate back to normal speed or to a third speed that is determined to be an efficient speed based on the health of the damaged rail car's wheel and the health of the track.

Using a different example, the combination of discrete information sources (geographically discrete and temporally discrete) with continuous monitoring by an on-board rail health monitor and/or broken rail detector allows for the controller in the locomotive to provide real time control over the speed and operation of the train. In one embodiment, information from a wayside detector can inform a locomotive that there is a problem or potential problem with a wheel and/or combo. The locomotive may then switch operating modes based on that information. One potential operating mode involves slowing or stopping the train. Another potential operating mode involves monitoring the train set for indications that the wheel and/or combo are exhibiting the problem. For example, if a wayside detector indicates that there is a hot axle, the locomotive can monitor the train for increased drag. If an axle seizes up, the increased resistance (or increased coupler force if there is a coupler sensor) can be detected as increased drag and an on-board the rail car sensor can alert the locomotive controller. The controller can then implement a determined action in response to detecting the increased drag.

Suitable other operating modes may include the use or prevention of the use of adhesion modifiers. Adhesion modifiers may be materials applied to a section of the track, such as lubricants or traction enhancers. Naturally, the lubricants may reduce friction and grip, while the traction enhancers increase it. Suitable traction enhancers may include blasted air (under defined conditions) as well as sanding and other traction enhancing techniques. Yet another operating mode may include engaging or disabling a dynamic weight management (DWM) system. The DWM system may lift or drop one or more axles to affect the weight distribution of a vehicle or vehicle system. And, another operating mode may reduce or increase wheel torque, may engage or prevent one or the other of dynamic braking or air braking, or may control the rate at which a vehicle may change its rate of acceleration or deceleration (for locomotives, that may be the rate at which notch levels may be changed).

In one embodiment, the combination of information from the plurality of discrete sources and the continuous source(s) is used to prevent derailment due to a broken wheel. In one embodiment, the combination of information from the plurality of discrete sources and the continuous source(s) is used to prevent derailment due to a locked axle. In one embodiment, the combination of information from the plurality of discrete sources and the continuous source(s) is used to prevent derailment due to a broken rail.

In various embodiments, other sources of information may provide additional information. For example, weather services may provide data about the current, previous, or upcoming weather events.

In other contemplated embodiments, logically coupled or remote controlled vehicles may be used rather than locomotives. Logically coupled groups of vehicles include those that are not mechanically coupled (as are locomotives, multi-unit over-the-road trucks, and the like) but rather have a control system that operates the vehicle (speed, direction, and the like) relative to another vehicle that is nearby or relative to a stationary object. In that manner, a lead vehicle may have a human operator with a trail vehicle that is otherwise driverless and is controlled by the lead vehicle so that it, for example, follows behind and mirrors the movement and speed of the lead vehicle.

Figure 3:
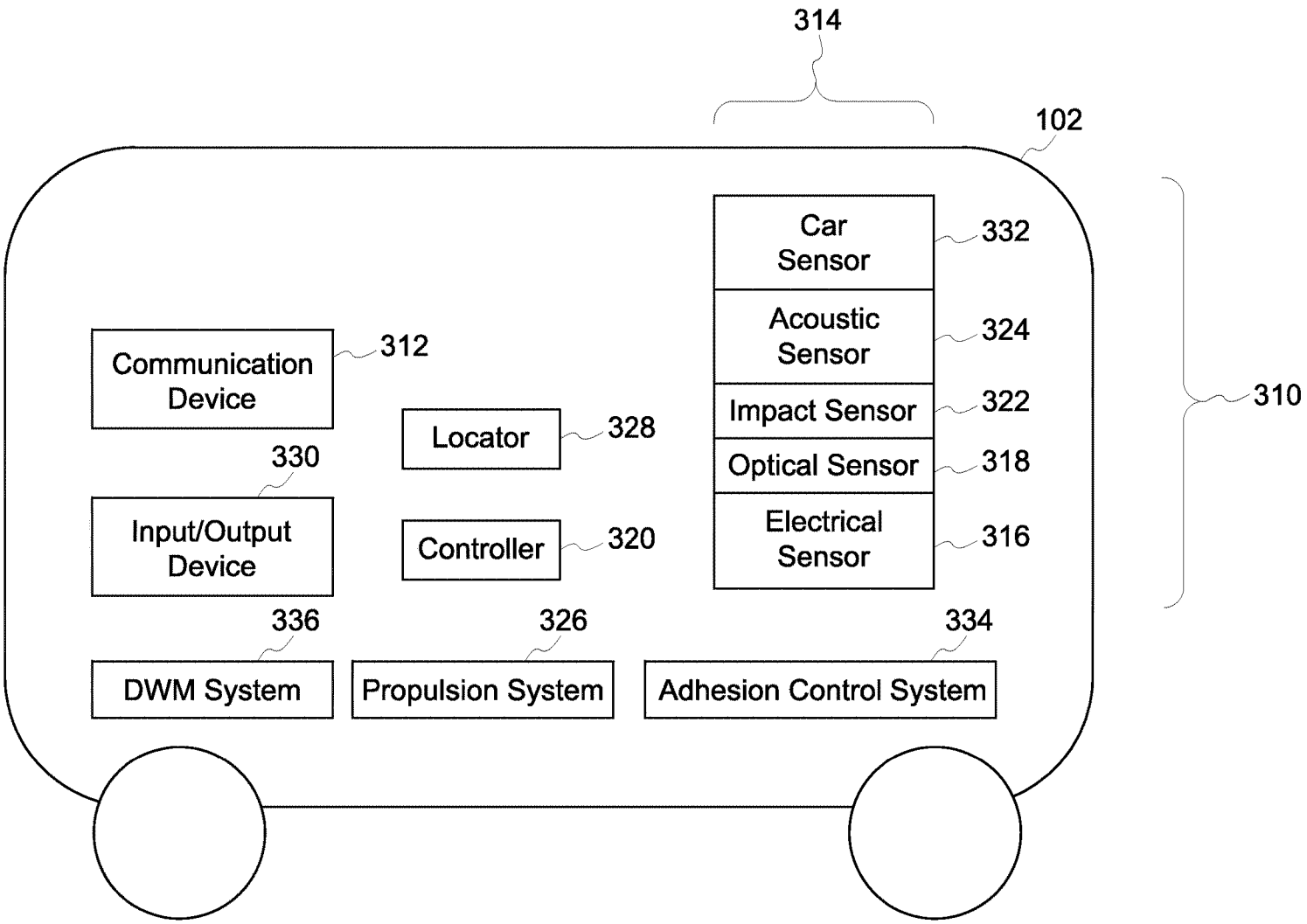
FIG. 3 includes a schematic illustration of an examination system according to one embodiment.

FIG. 3 includes a schematic illustration of an examination system 310 according to one embodiment. The examination system 310 is shown as being disposed onboard the test vehicle 102, but optionally may be disposed onboard another vehicle and/or may be distributed among two or more vehicles in the vehicle system 106 shown in FIG. 1. The system 310 includes communication equipment 312 ("Communication Device" in FIG. 3) that allows for data transmission with one or more other equipment sets off-board that vehicle. The communication equipment 312 can represent transceiving circuitry, such as modems, radios, antennas, or the like, for communicating data signals with off-board locations, such as other vehicles in the same vehicle system, other vehicle systems, or other off-board locations. The communication equipment can communicate the data signals to report the parameters of the route as measured by the examination system. The communication equipment can communicate the data signals in real time, near real time, or periodically.

Examination equipment 314 can include one or more electrical sensors 316 that measure one or more electrical characteristics of the route and/or catenary as parameters of the route and/or catenary. The electrical sensor may be referred to as a broken rail monitor because the electrical sensor generates data representative of whether the rail of a route is broken. The electrical sensors 316 can include conductive and/or magnetic bodies such as plates, coils, brushes, or the like, that inject an electrical signal into the route (or a portion thereof) and that measure one or more electrical characteristics of the route in response thereto, such as voltages or currents conducted through the route, impedances or resistances of the route, etc. Optionally, the electrical sensors 316 can include conductive and/or magnetic bodies that generate a magnetic field across, though, or around at least part of the route and that sense one or more electrical characteristics of the route in response thereto, such as induced voltages, induced currents, or the like, conducted in the route.

In one aspect, the electrical sensor 316 and/or a controller 320 of the examination system 310 can determine structure parameters and/or environmental parameters of the route based on the electrical characteristics that are measured. For example, depending on the voltage, current, resistance, impedance, or the like, that is measured, the route bed and/or ballast beneath the route may be determined to have water, ice, or other conductive materials (with the voltage or current increasing and the resistance or impedance decreasing due to the presence of water or ice and the voltage or current decreasing and the resistance or impedance increasing due to the absence of water or ice) and/or damage to joints, ties, sleepers, fasteners, switches, and crossings can be identified (with the voltage or current increasing and the resistance or impedance decreasing for less damage and the voltage or current decreasing and the resistance or impedance increasing due to the increasing damage).

The examination equipment 314 can include one or more optical sensors 318 that optically detect one or more characteristics of the route and/or catenary as parameters of the route and/or catenary. The optical sensor may be referred to as a broken rail monitor because the optical sensor generates data representative of whether the rail of a route is broken. The optical sensor 318 can include one or more cameras that obtain images or videos of the route. LIDAR (light generating devices such as lasers and light sensitive sensors such as photodetectors) that measure reflections of light off various portions of the route, thermographic cameras that obtain images or videos representative of thermal energy emanating from the route or catenary, etc. Optionally, the optical sensor 318 can include one or more x-ray emitters and/or detectors that generate radiation toward the route and/or the areas around the route and detect reflections of the radiation off of the route and/or other areas. These reflections can be representative of the route and/or damage to the route.

The optical sensor 318 can represent hardware circuitry that includes and/or is connected with one or more processors (e.g., microprocessors, field programmable gate arrays, integrated circuits, or other electronic logic-based devices) that examine the data measured by the optical sensor 318 to generate parameters of the route. For example, the optical sensor 318 can examine the images, videos, reflections of light, etc., to determine parameters such as geometries of the route (e.g., curvature of one or more rails, upward or downward bends in one or more rails, grade of the route, etc.), damage to the route (e.g., cracks, pits, breaks, holes, etc. in the route), a type of the route (e.g., a track, a road, etc.), or other information about the route. Alternatively, the optical sensor 318 may obtain the images, videos, reflections, etc., and report this data to the controller 320, which examines the data to determine the parameters of the route. In one aspect, the optical sensor and/or the controller can determine route parameters, structure parameters, and/or environmental parameters of the route using the optical data that is obtained by the optical sensor.

The examination equipment 314 can include one or more impact sensors 322 that detect impacts of the vehicle 102 during movement along the route. The impact sensor may be referred to as a broken rail monitor because the impact sensor generates data representative of whether the rail of a route is broken. Optionally, the impact sensor may be referred to as an asset health monitor because the impact sensor generates data representative of the condition of the vehicle or vehicle system. The impact sensor 322 can represent an accelerometer that generates data representative of accelerations of the vehicle 102, such as those accelerations that can occur when one or more wheels of the vehicle 102 travel over a damaged portion of the route, wheels travel over a gap between neighboring sections of the route, a wheel of the vehicle has a flat spot, a wheel is not aligned with the route (e.g., with a rail of the route), or a wheel has some other defect associated with it, etc. The impact sensor 322 can represent hardware circuitry that includes and/or is connected with one or more processors (e.g., microprocessors, field programmable gate arrays, integrated circuits, or other electronic logic-based devices) that examine the accelerations measured by the impact sensor 322 to generate parameters of the route. For example, the impact sensor 322 can examine the accelerations to determine whether the vehicle 102 traveled over a gap in the route, such as may occur when the route is broken into two or more neighboring sections. Alternatively, the impact sensor 322 may measure the accelerations and report the accelerations to the controller 320, which examines the accelerations to determine the parameters of the route.

The examination equipment 314 can include one or more acoustic sensors 324 that detect sounds generated during movement of the vehicle 102 along the route. The acoustic sensor may be referred to as a broken rail monitor because the acoustic sensor generates data representative of whether the rail of a route is broken. In one embodiment, the acoustic sensor 324 includes one or more ultrasound or ultrasonic transducers that emit ultrasound waves or other acoustic waves toward the route and detect echoes or other reflections of the waves off the route and/or locations near the route (e.g., the surface beneath the route, objects or debris on top of the route, etc.). The detected echoes or reflections represent acoustic data of the route, which may be used to determine parameters of the route. Optionally, the acoustic sensor 324 can represent an acoustic pick up device, such as a microphone, that generates data representative of sounds generated by the vehicle 102 traveling over the route. Sounds may be generated when one or more wheels of the vehicle 102 travel over a damaged portion of the route, a gap between neighboring sections of the route, etc. The acoustic sensor 324 can represent hardware circuitry that includes and/or is connected with one or more processors (e.g., microprocessors, field programmable gate arrays, integrated circuits, or other electronic logic-based devices) that examine the sounds detected by the acoustic sensor 324 to generate parameters of the route. For example, the acoustic sensor 324 can examine the sounds to determine whether the vehicle 102 traveled over a gap in the route, such as may occur when the route is broken into two or more neighboring sections. Alternatively, the acoustic sensor 324 may detect the sounds and report the sounds to the controller 320, which examines the sounds to determine the parameters of the route.

The acoustic sensor and/or controller can determine route parameters, structure parameters, and/or environmental parameters from the sounds that are detected. For example, the echoes that are detected by the acoustic sensor may be examined to identify cracks, pits, or other damage to the route. These echoes may represent areas inside the route that are damaged, which may not be visible from outside of the route. Optionally, designated sounds and/or sounds having one or more designated frequencies may indicate damage to the route that indicates changes in the level, grade, condition, grade, or the like of the route, changes in the route bed or ballast, damage to joints, damage to ties or sleepers, damage to fasteners, damage to or improperly functioning switches, improperly functioning crossings, changes to the sub-grade, the presence of brush or trees near the route (e.g., when the vehicle contacts the brush or trees), travel of wheels over segments of the route having grease or oil disposed on the route, the presence of leaves of the route, the presence of snow, ice, or water on the route, sand or dirt build up on the route, and the like.

The examination equipment 314 can include one or more car sensors 332 that detect characteristics of the test vehicle or another vehicle in the same vehicle system. The car sensor may be referred to as an asset health monitor because the car sensor generates data representative of the health of the vehicle or vehicle system. The car sensor 332 can include one or more speed sensors (e.g., tachometers), accelerometers, thermal sensors (e.g., infrared sensors that detect heat given off of bearings, axles, wheels, or the like), or other sensors that detect characteristics of the vehicle. The car sensor and/or controller can determine car parameters of the test vehicle and/or another vehicle in the vehicle consist. For example, the speeds that are detected by the car sensor may be rotational speeds of one or more wheels of the vehicle, and can be used to measure wheel creep or other characteristics representative of adhesion between the wheels and the route. The car sensor can measure accelerations of the vehicle to determine impacts of the vehicle on the route and/or with another vehicle in order to determine how much force is imparted on the vehicle and/or route. The car sensor can measure temperatures of bearings, axles, wheels, or the like, in order to determine if the bearings, axles, wheels, or the like, are overheating (and possibly indicative of a stuck axle or wheel).

While the test vehicle is illustrated as including wheels for land-based travel, as described above, the test vehicle optionally may travel on land using other components, may fly alongside or above the route (e.g., as an aerial vehicle), or the like. The test vehicle may include a propulsion system 326 that performs work to propel the test vehicle. The propulsion system can represent one or more engines, alternators, generators, batteries, capacitors, motors, or the like, that generate and/or receive energy (e.g., electric current) in order to power vehicle and propel the vehicle along the route. Alternatively, the test vehicle may not include the propulsion system. For example, the test vehicle may be pulled and/or pushed along the route by one or more other vehicles having propulsion systems, or may be manually pulled and/or pushed along the route.

While the preceding description focuses on the sensors onboard the test vehicle examining the route, optionally, one or more of the sensors may examine a catenary from which the test vehicle or the vehicle system that includes the test vehicle obtains electric current (e.g., for powering the vehicle system). For example, the electrical sensor may sense the current supplied from the catenary in order to identify surges or drops in the current (which may be indicative of damage to the catenary or equipment onboard the vehicle that receives current from the catenary). As another example, the optical sensor may obtain images of the catenary, videos of the catenary, or x-ray reflections off of the catenary in order to identify damage to the catenary.

The test vehicle includes a location device 328 ("Locator" in FIG. 3) that determines locations of the test vehicle or the vehicle system along the route at one or more times. The location device optionally may be disposed onboard another vehicle of the vehicle system that includes the test vehicle. The location device can include a global positioning system receiver, a wireless antenna, a reader that communicates with roadside transponders, or the like. Based on signals received from one or more off-board sources (e.g., satellites, cellular signals from cellular towers, wireless signals from transponders, etc.), the location device can determine the location of the location device (and, consequently, the test vehicle or vehicle system). Optionally, the location device can represent hardware circuitry that includes and/or is connected with one or more processors (e.g., microprocessors, field programmable gate arrays, integrated circuits, or other electronic logic-based devices) and/or a speed sensor (e.g., a tachometer). The location device can determine the location of the test vehicle or vehicle system by integrating speeds measured by the speed sensor over time from a previously known or determined location in order to determine a current location of the test vehicle and/or vehicle system.

The controller 320 of the test vehicle represents hardware circuitry that includes and/or is connected with one or more processors (e.g., microprocessors, field programmable gate arrays, integrated circuits, or other electronic logic-based devices) that may examine the data measured by the examination equipment 314 to determine parameters of the route (e.g., route parameters, environmental parameters, structure parameters, etc.). Optionally, the examination equipment may determine one or more of these parameters. The controller may communicate with an input/output device 330 and/or the propulsion system 326 to control movement of the test vehicle and/or vehicle system (that includes the test vehicle) based on the parameters that are determined. For example, the controller may automatically change operation of the propulsion system to stop or slow movement of the vehicle system responsive to determining that a parameter indicates damage to the route, damage to the vehicle (e.g., damage to a wheel), debris on the route, or other unsafe operating conditions. Alternatively, the input/output device can represent one or more displays, touchscreens, speakers, or the like, that the controller can cause to present instructions or warnings to an operator of the vehicle system. The controller may cause the instructions or warnings to be displayed to cause the operator to change operation of the vehicle or vehicle system in response to determining that one or more of the parameters indicates an unsafe operating condition. The input/output device 330 optionally can represent one or more input devices, such as levers, buttons, touchscreens, keyboards, steering wheels, or the like, for receiving input into the controller from an operator of the vehicle system.

In one embodiment, responsive to determining that a parameter indicates damage or deteriorating conditions of the route, the controller may communicate a warning signal to an off-board location, such as the facility 306 shown in FIG. 2. This warning signal may report the parameter that is indicative of the route damage or deteriorating condition, and the location at which the damage or deteriorating condition is identified. The deteriorating condition may include debris on the route, shifted or decreased ballast material beneath the route, overgrown vegetation on the route, damage to the route, a change in geometry of the route (e.g., one or more rails have become bent or otherwise changed such that the shape of one segment of the route is different from a remainder of the route), etc. The warning signal may be communicated automatically responsive to determining the parameter, and may cause the off-board location to automatically schedule additional inspection, maintenance, or repair of the corresponding portion of the route. In one embodiment, communication of the warning signal may cause the off-board location to change the schedules of one or more other vehicle systems. For example, the off-board location may change the schedule of other vehicle systems to cause the vehicle systems to travel more slowly or to avoid the location with which the parameter is associated. Optionally, the warning signal may be broadcast or transmitted by the communication device to one or more other vehicles to warn the vehicles, without being first communicated to the off-board location.

In one example of operation of the test vehicle, the vehicle can operate as a self-aware vehicle that continuously monitors itself and/or the route during movement of the vehicle or vehicle system along the route. Some known rail safety systems and methods consist of visual inspections of a track (e.g., hi-rail systems) and cars (e.g., such as visual inspections that occur in rail yards) combined with periodic inspections of the track and inspection of the cars by stationary wayside units. One significant drawback with these known systems and methods is that the inspections of the route and vehicles are discrete in time and space. With respect to time, the track and/or cars may only be inspected periodically, such as every three weeks, every six months, and the like. Between these discrete times, the track and/or cars are not inspected. With respect to location, the cars may be inspected as the cars move past stationary wayside units disposed at fixed locations and/or portions of the track that are near stationary wayside units may be inspected by the units, but between these locations of the wayside units, the track and/or cars are not inspected.

The examination system described herein can operate using the test vehicle as a hub (e.g., a computer center) that is equipped with broken route inspection equipment (e.g., the examination system 314) for detecting damage or deteriorating conditions of the route during movement of the test vehicle. The parameters of the route that are generated by the examination system can be used to identify damaged sections of the route or sections of the route that require repair or maintenance. Optionally, the controller of the test vehicle can examine both the parameters provided by the examination system and historical parameters of the route. The historical parameters of the route can include the parameters determined from data measured by the examination system onboard the test vehicle and/or one or more other test vehicles during a previous time or trip. For example, the historical parameters may represent the condition or damage of the route as previously measured by the same or a different examination system. The historical parameters may be communicated from an off-board location, such as the facility 306 shown in FIG. 2, and based on the data measured by and provided from the examination systems onboard the same and/or different vehicles.

The examination system onboard a test vehicle can use a combination of the currently determined parameters (e.g., the parameters determined by the examination system onboard the test vehicle during movement of the test vehicle) and previously determined parameters (e.g., the parameters determined by the examination system onboard the same test vehicle or another test vehicle during a previous traversal over the same route or section of the route and/or parameters previously determined by one or more wayside units) to control operation of the vehicle system. As one example, if previously determined parameters indicate that damage to a segment of the route is increasing (e.g., a size of a crack in the rail is increasing), but is not yet sufficiently severe to cause the vehicle system to avoid the segment of the route, to warn other vehicle systems of the damage, or to request inspection, repair, and/or maintenance of the route, then the controller may activate one or more of the examination equipment (e.g., where not all of the examination equipment is constantly activated) for continuous monitoring of the parameters of the route during movement over the same segment of the route.

The examination system onboard a test vehicle can use a combination of the currently determined parameters of the vehicle and previously determined parameters of the vehicle to control operation of the vehicle system. As one example, if a warm or hot bearing is detected by a wayside unit on a particular car in a vehicle system, then the examination system can direct the car sensor 332 onboard that car to measure the temperature of the bearing more frequently and/or at a finer resolution in order to ensure that the bearing temperature does not increase exponentially between wayside units.

The vehicle system that includes the test vehicle optionally may include an adhesion control system 334. Although the adhesion control system is shown in FIG. 3 as being onboard the test vehicle, optionally, the adhesion control system may be disposed onboard another vehicle of the same vehicle system. The adhesion control system represents one or more components that apply one or more adhesion-modifying substances to the route in order to change adhesion between the vehicle system (or a portion thereof) and the route. The adhesion control system can include one or more sprayers or other application devices that apply the adhesion-modifying substances and/or one or more tanks that hold the adhesion-modifying substances. The adhesion-modifying substances can include air, lubricants, sand, or the like. The controller may direct the adhesion control system as to when to apply the adhesion-modifying substances, which adhesion-modifying substances to apply, and how much of the adhesion-modifying substances are to be applied.

Based on the parameters of the route and/or vehicle that are determined by the system 310, the operating mode of the controller may change to use or prevent the use of adhesion-modifying substances. If the parameters indicate that wheels of the vehicle system are slipping relative to the route, then the controller may prevent the adhesion control system from applying substances that reduce adhesion of the wheels to the route or may direct the adhesion control system to apply one or more substances that increase adhesion. If the parameters indicate that debris or other substances are on the route, then the controller may direct the adhesion control system to apply one or more substances that remove the debris (e.g., by directing air across the route).

The vehicle system that includes the test vehicle optionally may include the DWM system 336. Although the DWM system is shown in FIG. 3 as being onboard the test vehicle, optionally, the DWM system may be disposed onboard another vehicle of the same vehicle system. The DWM system includes one or more motors, gears, and the like, that are interconnected with axles of the vehicle on which the DWM system is disposed and may lift or drop one or more axles (relative to the route). The raising or lowering of axles can change the weight distribution of the vehicle or vehicle system on the route. Based on the parameters of the route and/or vehicle that are determined by the system 310, the operating mode of the controller may change to raise or lower one or more axles of the vehicle system. If the parameters indicate that significant impact forces are being caused by wheels of the vehicle system, then the controller may direct the DWM system to raise those axles relative to the route or to lower multiple axles toward the route (and thereby reduce the force imparted by any single axle).

The controller may examine the parameters determined from the discrete sources (e.g., the manual and/or wayside unit inspection of the vehicle and/or route) to determine when to begin monitoring parameters of the vehicle and/or route using one or more continuous sources. For example, responsive to determining that a parameter of the vehicle or route (as determined from a wayside unit) indicates potential damage or deteriorating health (e.g., a damaged or bent rail, a hot bearing, etc.), the controller may direct the examination equipment 314 to begin continually monitoring parameters of the vehicle and/or route. The continuous monitoring may be for purposes of confirming the potential damage, identifying deteriorating health (changes in damage over time), quantifying or characterizing a nature or aspect of the damage, determining information relevant to vehicle control based on detected damage, etc. With respect to the route, this can involve the controller directing the examination equipment to continually measure data and determine parameters of the route during travel over a segment of the route associated with a parameter determined by a discrete source that indicates damage or a deteriorating condition of the route. The controller may stop the continual examination of the route and/or vehicle responsive to exiting a segment of the route identified by a discrete source as being problematic, responsive to receiving one or more additional parameters from a discrete source indicating that another segment of the route is not problematic, or once the parameter of the vehicle is identified as no longer indicating a problem with the vehicle. The discrete sources of route parameters and/or vehicle parameters can include the wayside units, results of a manual inspection, or the like. In one embodiment, a weather service may provide data about the current, previous, or upcoming weather events as a discrete source of route parameters.

In one embodiment, the controller may use a combination of parameters from one or more discrete sources and one or more continuous sources to identify a broken wheel, locked axle, broken rail, or the like. For example, the parameters of the vehicle obtained from one or more wayside units may indicate that a wheel has a relatively small crack, flat spot, or other minor damage. The parameters may not be significant enough to cause the vehicle system to stop moving along the route. The controller may receive these parameters and then begin continually monitoring the wheel using one or more sensors of the examination equipment. The continually monitored parameter or parameters of the wheel may identify a decreasing trend in the health of the wheel. For example, the parameter that is continually monitored by the examination equipment may demonstrate that the crack is growing in size, that the flat spot is growing in size, or that other damage to the wheel is getting worse with respect to time. The controller can examine the changes in the continually monitored parameter(s) of the wheel with respect to time and, responsive to the changes exceeding one or more limits or approaching one or more limits, the controller can slow down or stop movement of the vehicle system before the wheel breaks, automatically request a change in the schedule of the vehicle system to obtain inspection and/or repair of the wheel, automatically request maintenance or repair of the wheel, etc. This can result in the wheel being continually monitored in response to the discrete source of information (e.g., the wayside unit) determining that the wheel may have a problem that otherwise would not prevent the vehicle system from proceeding. Due to the continual monitoring of the wheel, derailment of the vehicle system may be avoided prior to a subsequent discrete examination of the wheel.

In another example, the parameters of the vehicle obtained from one or more wayside units may indicate that an axle may be at least partially stuck (e.g., the parameters may indicate elevated temperatures of bearings and/or a wheel connected with the axle). The controller may receive these parameters and then begin continually monitoring the axle using one or more sensors of the examination equipment. The continually monitored parameter or parameters of the axle may indicate an increasing temperature of the bearings. The controller can examine the changes in the continually monitored parameter(s) of the axle with respect to time and, responsive to the increasing temperatures exceeding one or more limits or approaching one or more limits, the controller can slow down or stop movement of the vehicle system before the axle locks up, automatically request a change in the schedule of the vehicle system to obtain inspection and/or repair of the axle, automatically request maintenance or repair of the axle, etc. This can result in the axle being continually monitored in response to the discrete source of information (e.g., the wayside unit) determining that the axle may have a problem that otherwise would not prevent the vehicle system from proceeding. Due to the continual monitoring of the axle, derailment of the vehicle system may be avoided prior to a subsequent discrete examination of the axle.

In another example, the parameters of the route obtained from one or more wayside units may indicate that a segment of the route is damaged (e.g., the parameters may indicate cracks in the route). The controller may receive these parameters prior to travel over the route segment and begin continually monitoring the route using one or more sensors of the examination equipment. The continually monitored parameter or parameters of the route may indicate increasing damage to the route. The controller can examine the changes in the continually monitored parameter(s) of the route and, responsive to the increasing damage exceeding one or more limits or approaching one or more limits, the controller can slow down or stop movement of the vehicle system before the route is impossible to be traveled upon (e.g., a rail breaks), automatically request a change in the schedule of the vehicle system to avoid traveling over the route segment, automatically request maintenance or repair of the route segment, etc. This can result in the route being continually monitored in response to the discrete source of information (e.g., the wayside unit) determining that the route is at least partially damaged (but still able to be traveled upon). Due to the continual monitoring of the route, derailment of the vehicle system may be avoided prior to a subsequent discrete examination of the route.

Figure 4:
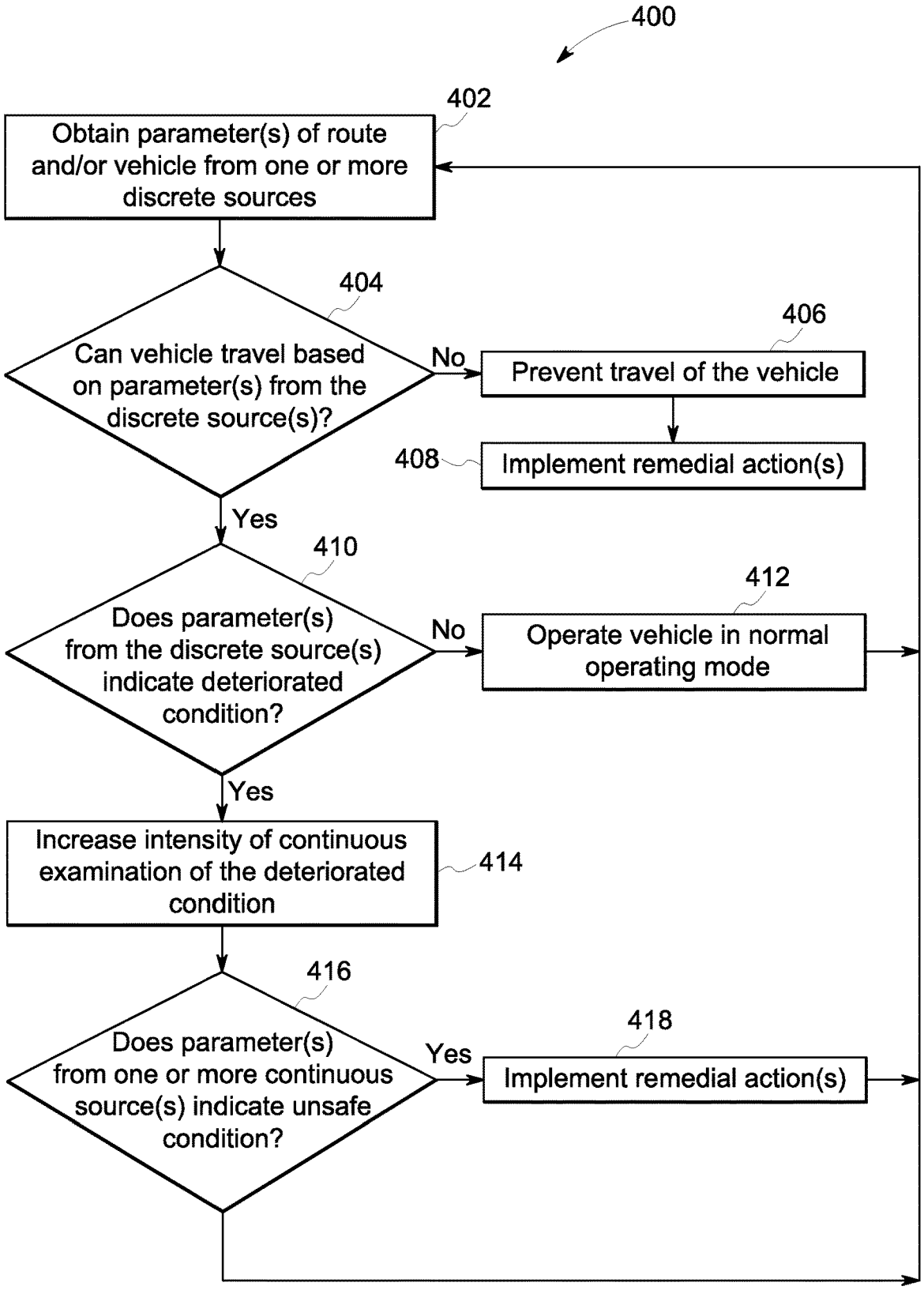
FIG. 4 illustrates a flowchart of one embodiment of a method for examining a vehicle and/or route.

FIG. 4 illustrates a flowchart of one embodiment of a method 400 for examining a vehicle and/or route. The method 400 may be performed by one or more embodiments of the vehicle systems, vehicles, and examination systems described herein. In one embodiment, the method 400 may represent or be used to generate a software program that directs at least some operations of the controller and/or examination system described herein.

At 402, one or more parameters of a route and/or vehicle are obtained from one or more discrete sources. The route and/or vehicle parameters may be obtained from a wayside unit, from a manual inspection, or another type of inspection of the route and/or vehicle that is not continuous in time and/or is not continuous in location. For example, the parameters may result from the periodic examination of the route and/or vehicle and/or from examination of the route and/or vehicle in a single location (but not other locations).

At 404, a determination is made as to whether the parameter obtained from the discrete source indicates that the vehicle should not travel along the route. For example, the obtained parameter may indicate that the damage to the route and/or vehicle is so severe that the vehicle cannot safely proceed with travelling beyond the location where the discrete examination of the route or vehicle occurred. As a result, flow of the method 400 can proceed toward 406. On the other hand, if the parameter from the discrete source does not indicate that continued travel of the vehicle is unsafe, then flow of the method 400 can proceed toward 410.

At 406, travel of the vehicle is prevented. For example, the controller of the vehicle or vehicle system may prevent further movement of the vehicle or vehicle system over the portion of the route that is too badly damaged to safely travel over. At 408, one or more remedial actions can be implemented. These remedial actions alternatively can be referred to as control actions, and may include slowing or stopping movement of the vehicle system, automatically requesting inspection, maintenance, or repair of the vehicle system and/or route, communicating with an off-board location of the location of the damaged route and/or vehicle, communicating warnings to other vehicle systems of the damaged route, etc. Flow of the method 400 may terminate or return to 402.

At 410, a determination is made as to whether the parameter from the discrete source indicates a deteriorated condition of the route and/or vehicle. The parameter may indicate a deteriorated condition of the route and/or vehicle when the route and/or vehicle are damaged, but not damaged so significantly that travel is not possible over the route. For example, such a parameter can indicate damage, but not a break, in the route; a bearing with an increased temperature but with an axle that is still able to rotate; a wheel having a non-circular segment along the outer perimeter of the wheel, but not yet a flat spot, etc. The parameter may not indicate a deteriorated condition of the route and/or vehicle when the route and/or vehicle are not damaged. If the parameter does not indicate a deteriorated condition, then flow of the method 400 can proceed toward 412. If the parameter indicates a deteriorated condition, then flow of the method 400 can proceed toward 414.

At 412, the vehicle can operate in a normal operating mode. In one embodiment, the normal operating mode includes the examination equipment not continually examining the route and/or vehicle. For example, one or more of the sensors may deactivate and not collect data representative of parameters of the route and/or vehicle. Flow of the method 400 can return toward 402 where additional parameters of the vehicle and/or route are obtained from another discrete source. This can involve the vehicle traveling to another location of a wayside unit or receiving additional information from a manual inspection of the vehicle and/or route.

At 414, the examination system can increase an intensity at which continuous examination of a deteriorated condition is performed during a continuous operating mode. In one example, if no continuous examining of the route and/or vehicle is being performed prior to 414, then at 414, continuous examining may begin in a continuous operating mode. In another example, if at least some continuous examining of the route and/or vehicle is being performed prior to 414, then at 414, the intensity at which this continuous examination is occurring is increased. The intensity can be increased by increasing a frequency at which data is measured, by activating and using additional sensors to monitor the route and/or vehicle, by increasing a resolution of the data being measured, etc.

The continuous operating mode can include one or more examination equipment continually monitoring parameters of the vehicle and/or route. The continuous monitoring can include obtaining additional data of the condition or state of the vehicle and/or route from continuous sources (e.g., sources onboard the vehicle) between the discrete sources obtaining the data of the condition or state of the vehicle. Alternatively, the continuous monitoring can include obtaining several data points (or measurements of data) during movement of the vehicle over the route. Alternatively, the continuous monitoring can mean obtaining data representative of conditions of the route and/or vehicle from one or more sensors disposed onboard the vehicle.

At 416, the parameter obtained from the continuous sources is examined to determine if the parameter indicates an unsafe condition. The unsafe condition may indicate increasing severity or magnitude in damage to the route and/or vehicle, as identified by the continuous monitoring of the route and/or vehicle. For example, such a parameter can indicate increasing damage in the route as the vehicle progresses along the route; a bearing with increasing temperature; a wheel having the non-circular segment that is becoming more flat, etc. If the parameter indicates an unsafe condition, such as worsening damage of the vehicle and/or route, then flow of the method 400 can proceed toward 418. Otherwise, flow of the method 400 can return toward 402.

At 418, one or more control actions (e.g., remedial actions) can be implemented. These control actions can include slowing or stopping movement of the vehicle system, automatically requesting inspection, maintenance, or repair of the vehicle system and/or route, communicating with an off-board location of the location of the damaged route and/or vehicle, communicating warnings to other vehicle systems of the damaged route, etc. Flow of the method 400 may terminate or return to 402.

In one embodiment, a system (e.g., an examination system) includes a controller that is operable to receive information from a plurality of discrete information sources and from a continuous information source on-board a vehicle system. The controller also is operable to control one or both of speed and operation of the vehicle system based on the information received from the discrete information sources and the continuous information source.

In one embodiment, a system (e.g., an examination system) includes a controller and examination equipment. The controller is configured to obtain one or more of a route parameter or a vehicle parameter from discrete examinations of one or more of a route or a vehicle system. The route parameter is indicative of a health of the route over which the vehicle system travels. The vehicle parameter is indicative of a health of the vehicle system. The discrete examinations of the one or more of the route or the vehicle system are separated from each other by one or more of location or time. The controller also is configured to examine the one or more of the route parameter or the vehicle parameter to determine whether the one or more of the route or the vehicle system is damaged. The examination equipment is configured to continually monitor the one or more of the route or the vehicle system responsive to determining that the one or more of the route or the vehicle is damaged.

In one aspect, the controller is operable to receive at least a portion of the one or more of the route parameter or the vehicle parameter from a stationary wayside unit disposed alongside the route being traveled by the vehicle system.

In one aspect, the controller is operable to receive the at least the portion of the one or more of the route parameter or the vehicle parameter from the wayside unit that includes information relating to whether there is a problem or potential problem with a wheel of the vehicle system.

In one aspect, the controller is operable to switch operating modes of the vehicle system based on at least one of the one or more of the route parameter or the vehicle parameter from the discrete examinations or information communicated from the examination equipment from continually monitoring the one or more of the route or the vehicle system.

In one aspect, at least one of the operating modes comprises the controller slowing or stopping movement of the vehicle system.

In one aspect, at least one of the operating modes comprises the controller monitoring the vehicle system for one or more indications that a wheel is exhibiting a problem with the vehicle system.

In one aspect, the controller is operable to receive the one or more of the route parameter or the vehicle parameter as information that is one or both of geographically discrete or temporally discrete.

In one aspect, the examination equipment includes one or more of an asset health monitor or a broken rail detector.

In one aspect, the controller is configured to prevent or reduce a probability of occurrence of a derailment of the vehicle system due to at least one of a broken wheel, a locked axle, or a broken rail based on the one or more of the route parameter or the vehicle parameter received from the discrete examinations and information received from the examination equipment relative to the controller not receiving the one or more of the route parameter or the vehicle parameter and the information from the examination equipment.

In another embodiment, a method (e.g., for examining a route and/or vehicle system) includes obtaining one or more of a route parameter or a vehicle parameter from discrete examinations of one or more of a route or a vehicle system. The route parameter is indicative of a health of the route over which the vehicle system travels. The vehicle parameter is indicative of a health of the vehicle system. The discrete examinations of the one or more of the route or the vehicle system are separated from each other by one or more of location or time. The method also includes examining the one or more of the route parameter or the vehicle parameter to determine whether the one or more of the route or the vehicle system is damaged and, responsive to determining that the one or more of the route or the vehicle is damaged, continually monitoring the one or more of the route or the vehicle system.

In one aspect, the one or more of the route parameter or the vehicle parameter is obtained from a stationary wayside unit disposed along the route.

In one aspect, continually monitoring the one or more of the route or the vehicle system includes continually monitoring the one or more of the route parameter or the vehicle parameter from examination equipment disposed onboard the vehicle system.

In one aspect, continually monitoring the one or more of the route or the vehicle system occurs between plural discrete examinations of the one or more of the route or the vehicle system.

In one aspect, the plural discrete examinations of the one or more of the route or the vehicle system one or more of occur during different, non-overlapping time periods or occur at different locations, with the continually monitoring of the one or more of the route or the vehicle system occurring one or more of between the different, non-overlapping time periods or between the different locations.

In one aspect, the method also includes implementing a control action responsive to determining that the one or more of the route or the vehicle system is damaged based on continually monitoring the one or more of the route or the vehicle system. The control action includes one or more of automatically slowing or stopping movement of the vehicle system, automatically requesting inspection, repair, or maintenance of the one or more of the route or the vehicle system, applying an adhesion-modifying substance to the route, preventing application of the adhesion-modifying substance to the route, lifting one or more axles of the vehicle system away from the route, or lowering the one or more axles of the vehicle system toward the route.

In one aspect, both the route parameter and the vehicle parameter are obtained from the discrete examinations of the route and the vehicle system, respectively. The route parameter and the vehicle parameter can be examined to determine whether the route or the vehicle system is damaged, respectively. The one or more of the route or the vehicle system can be continually monitored, responsive to the determining damage of the one or more of the route or the vehicle, to at least one of confirm or quantify the damage. The method also can include controlling the vehicle system responsive to the damage that is at least one of confirmed or quantified.

In one aspect, at least one of the route parameter or the vehicle parameter is obtained from a stationary wayside unit disposed along the route. Continually monitoring the one or more of the route or the vehicle system can include continually monitoring the one or more of the route parameter or the vehicle parameter from examination equipment disposed onboard the vehicle system.

In one embodiment, a system (e.g., an examination system) includes one or more processors and examination equipment. The one or more processors are configured to obtain one or more of a route parameter or a vehicle parameter from discrete examinations of one or more of a route or a vehicle system. The route parameter is indicative of a health of the route over which the vehicle system travels. The vehicle parameter is indicative of a health of the vehicle system. The one or more processors also are configured to examine the one or more of the route parameter or the vehicle parameter to determine whether the one or more of the route or the vehicle system is damaged. The examination equipment is configured to continually monitor the one or more of the route or the vehicle system responsive to the one or more processors determining that the one or more of the route or the vehicle system is damaged based on the one or more of the route parameter or the vehicle parameter.

In one aspect, the one or more processors are configured to receive the one or more of the route parameter or the vehicle parameter from a stationary wayside unit disposed along the route.

In one aspect, the examination equipment is configured to be disposed onboard the vehicle system and to continually monitor the one or more of the route or the vehicle system during movement of the vehicle system.

In one aspect, the examination equipment includes one or more of a car sensor configured to measure a temperature of the vehicle system, an acoustic sensor configured to measure one or more ultrasound echoes or sounds of the vehicle system or the route, an impact sensor configured to measure one or more accelerations of the vehicle system, an optical sensor configured to one or more of obtain an image or video of the route or measure geometry of the route, or an electrical sensor configured to measure one or more electrical characteristics of the route.

In one aspect, the examination equipment is configured to continually monitor the one or more of the route or the vehicle system between plural discrete examinations of the one or more of the route or the vehicle system.

In one aspect, both the route parameter and the vehicle parameter are obtained from the discrete examinations of the route and the vehicle system, respectively. The route parameter and the vehicle parameter can be examined to determine whether the route or the vehicle system is damaged, respectively. The examination equipment can continually monitor the one or more of the route or the vehicle system responsive to the determining damage of the one or more of the route or the vehicle to at least one of confirm or quantify the damage. The one or more processors can be configured to control the vehicle system responsive to the damage that is at least one of confirmed or quantified.

In one embodiment, the one or more processors are configured to receive at least one of the route parameter or the vehicle parameter from a stationary wayside unit disposed along the route. The examination equipment is configured to be disposed onboard the vehicle system.

The above description is illustrative and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

As used herein, an element or step recited in the singular and proceeded with the word "a" or "an" should be understood as not excluding plural of said elements or steps, unless such exclusion is explicitly stated. Furthermore, references to "one embodiment" of the inventive subject matter are not intended to be interpreted as excluding the existence of additional embodiments that also incorporate the recited features. Moreover, unless explicitly stated to the contrary, embodiments "comprising," "including." or "having" an element or a plurality of elements having a particular property may include additional such elements not having that property.

The foregoing description of certain embodiments of the inventive subject matter will be better understood when read in conjunction with the appended drawings. To the extent that the figures illustrate diagrams of the functional blocks of various embodiments, the functional blocks are not necessarily indicative of the division between hardware circuitry.

Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A system comprising:

a controller onboard a rail vehicle system having at least one locomotive, the controller configured to obtain one or more of a route parameter or a rail vehicle parameter from discrete examinations of one or more of a route or the rail vehicle system, the route parameter indicative of a health of the route over which the rail vehicle system travels, the rail vehicle parameter indicative of a health of the rail vehicle system, the discrete examinations of the one or more of the route or the rail vehicle system separated from each other by one or more of location or time, the controller configured to examine the one or more of the route parameter or the rail vehicle parameter to determine whether the one or more of the route or the rail vehicle system is damaged; and examination equipment onboard the rail vehicle system configured to continually monitor the one or more of the route or the rail vehicle system, wherein the rail vehicle system is configured to switch from the discrete examinations of the one or more of the route or the rail vehicle system to continuous examinations of the one or more of the route or the rail vehicle system responsive to determining that the one or more of the route or the rail vehicle system is damaged during the discrete examinations, wherein the controller is configured to change movement of the rail vehicle system based on at least one or more of the controller or the examination equipment determining that the one or more of the route or the rail vehicle system is damaged.

2. The system of claim 1, wherein the controller is operable to receive the one or more of the route parameter or the rail vehicle parameter as information that is one or both of geographically discrete or temporally discrete.

3. The system of claim 1, wherein the examination equipment includes one or more of an asset health monitor or a broken rail detector.

4. The system of claim 1, wherein the controller is configured to prevent or reduce a probability of occurrence of a derailment of the rail vehicle system due to at least one of a broken wheel, a locked axle, or a broken rail based on the one or more of the route parameter or the rail vehicle parameter received from the discrete examinations and information received from the examination equipment relative to the controller not receiving the one or more of the route parameter or the rail vehicle parameter and the information from the examination equipment.

5. The system of claim 1, wherein the controller is operable to receive at least a portion of the one or more of the route parameter or the rail vehicle parameter from a stationary wayside unit disposed alongside the route being traveled by the rail vehicle system.

6. The system of claim 5, wherein the controller is operable to receive the at least the portion of the rail vehicle parameter from the wayside unit that includes information relating to whether there is a problem or potential problem with a wheel of the rail vehicle system.

7. The system of claim 1, wherein the controller is operable to switch operating modes of the rail vehicle system based on at least one of the one or more of the route parameter or the rail vehicle parameter from the discrete examinations or information communicated from the examination equipment from continually monitoring the one or more of the route or the rail vehicle system.

8. The system of claim 7, wherein at least one of the operating modes comprises the controller slowing or stopping movement of the rail vehicle system.

9. The system of claim 7, wherein at least one of the operating modes based on the rail vehicle parameter comprises the controller monitoring the rail vehicle system for one or more indications that a wheel is exhibiting a problem with the rail vehicle system.

10. A method comprising:

obtaining one or more of a route parameter or a rail vehicle parameter from discrete examinations of one or more of a route or a rail vehicle system, the rail vehicle system having at least one locomotive, the route parameter indicative of a health of the route over which the rail vehicle system travels, the rail vehicle parameter indicative of a health of the rail vehicle system, the discrete examinations of the one or more of the route or the rail vehicle system separated from each other by one or more of location or time;

examining the one or more of the route parameter or the rail vehicle parameter to determine whether the one or more of the route or the rail vehicle system is damaged;

responsive to determining that the one or more of the route or the rail vehicle system is damaged during the discrete examinations, continually monitoring the one or more of the route or the rail vehicle system, wherein the rail vehicle system is configured to switch from the discrete examinations of the one or more of the route or the rail vehicle system to continuous examinations of the one or more of the route or the rail vehicle system; and changing movement of the rail vehicle system based at least on whether one or more of the route or the rail vehicle system is damaged;

wherein continually monitoring the one or more of the route or the rail vehicle system includes continually monitoring the one or more of the route parameter or the rail vehicle parameter from examination equipment disposed onboard the rail vehicle system.

11. The method of claim 10, wherein the one or more of the route parameter or the rail vehicle parameter is obtained from a stationary wayside unit disposed along the route.

12. The method of claim 10, further comprising, responsive to determining that the one or more of the route or the rail vehicle system is damaged based on continually monitoring the one or more of the route or the rail vehicle system, implementing a control action, the control action including one or more of automatically slowing or stopping movement of the rail vehicle system, automatically requesting inspection, repair, or maintenance of the one or more of the route or the rail vehicle system, applying an adhesion-modifying substance to the route, preventing application of the adhesion-modifying substance to the route, lifting one or more axles of the rail vehicle system away from the route, or lowering the one or more axles of the rail vehicle system toward the route.

13. The method of claim 10, wherein continually monitoring the one or more of the route or the rail vehicle system occurs between plural discrete examinations of the one or more of the route or the rail vehicle system.

14. The method of claim 13, wherein the plural discrete examinations of the one or more of the route or the rail vehicle system one or more of occur during different, non overlapping time periods or occur at different locations, with the continually monitoring of the one or more of the route or the rail vehicle system occurring one or more of between the different, non overlapping time periods or between the different locations.

15. The method of claim 10, wherein:

both the route parameter and the rail vehicle parameter are obtained from the discrete examinations of the route and the rail vehicle system, respectively;

the route parameter and the rail vehicle parameter are examined to determine whether the route or the rail vehicle system is damaged, respectively;

the one or more of the route or the rail vehicle system are continually monitored, responsive to the determining damage of the one or more of the route or the rail vehicle system, to at least one of confirm or quantify the damage; and the method further comprises controlling the rail vehicle system responsive to the damage that is at least one of confirmed or quantified.

16. The method of claim 15, wherein at least one of the route parameter or the rail vehicle parameter is obtained from a stationary wayside unit disposed along the route, and wherein continually monitoring the one or more of the route or the rail vehicle system includes continually monitoring the one or more of the route parameter or the rail vehicle parameter from examination equipment disposed onboard the rail vehicle system.

17. A system comprising:

one or more processors onboard a rail vehicle system having at least one locomotive, the one or more processors configured to obtain one or more of a route parameter or a rail vehicle parameter from discrete examinations of one or more of a route or the rail vehicle system, the route parameter indicative of a health of the route over which the rail vehicle system travels, the rail vehicle parameter indicative of a health of the rail vehicle system, the one or more processors also configured to examine the one or more of the route parameter or the rail vehicle parameter to determine whether the one or more of the route or the rail vehicle system is damaged; and examination equipment configured to continually monitor the one or more of the route or the rail vehicle system, wherein the rail vehicle system is configured to switch from discrete examinations of the one or more of the route or the rail vehicle system to continuous examinations of the one or more of the route or the rail vehicle system responsive to the one or more processors determining that the one or more of the route or the rail vehicle system is damaged based on the one or more of the route parameter or the rail vehicle parameter, wherein the controller is configured to change movement of the rail vehicle system based on at least one or more of the controller or the examination equipment determining that the one or more of the route or the rail vehicle system is damaged.

18. The system of claim 17, wherein the one or more processors are configured to receive the one or more of the route parameter or the rail vehicle parameter from a stationary wayside unit disposed along the route.

19. The system of claim 17, wherein the examination equipment is configured to be disposed onboard the rail vehicle system and to continually monitor the one or more of the route or the rail vehicle system during movement of the rail vehicle system.

20. The system of claim 17, wherein the examination equipment includes one or more of a car sensor configured to measure a temperature of the rail vehicle system, an acoustic sensor configured to measure one or more ultrasound echoes or sounds of the rail vehicle system or the route, an impact sensor configured to measure one or more accelerations of the rail vehicle system, an optical sensor configured to one or more of obtain an image or video of the route or measure geometry of the route, or an electrical sensor configured to measure one or more electrical characteristics of the route.

21. The system of claim 17, wherein the examination equipment is configured to continually monitor the one or more of the route or the rail vehicle system between the discrete examinations of the one or more of the route or the rail vehicle system.

22. The system of claim 17, wherein:

the examination equipment is configured to be disposed onboard the rail vehicle system;

the one or more processors are configured to obtain both the route parameter and the rail vehicle parameter from the discrete examinations of the route and the rail vehicle system, respectively, and to examine the route parameter and the rail vehicle parameter to determine whether the route or the rail vehicle system is damaged, respectively;

the examination equipment is configured to continually monitor the one or more of the route or the rail vehicle system responsive to the determining damage of the one or more of the route or the rail vehicle system to at least one of confirm or quantify the damage; and the one or more processors are configured to control the rail vehicle system responsive to the damage that is at least one of confirmed or quantified, by at least one of: controlling a dynamic weight management system of the rail vehicle system to raise or lower one or more axles of the rail vehicle system; or using or preventing use of an adhesion control system of the rail vehicle system to increase or reduce adhesion of the rail vehicle system on the route.

23. The system of claim 17, wherein both the route parameter and the rail vehicle parameter are obtained from the discrete examinations of the route and the rail vehicle system, respectively, wherein the route parameter and the rail vehicle parameter are examined to determine whether the route or the rail vehicle system is damaged, respectively, wherein the examination equipment continually monitors the one or more of the route or the rail vehicle system responsive to the determining damage of the one or more of the route or the rail vehicle system to at least one of confirm or quantify the damage, and the one or more processors are configured to control the rail vehicle system responsive to the damage that is at least one of confirmed or quantified.

24. The system of claim 23, wherein the one or more processors are configured to receive at least one of the route parameter or the rail vehicle parameter from a stationary wayside unit disposed along the route, and wherein the examination equipment is configured to be disposed onboard the rail vehicle system.

* * * * *